US010286679B2

(12) United States Patent
Ohnishi

(10) Patent No.: US 10,286,679 B2
(45) Date of Patent: May 14, 2019

(54) PRINTING APPARATUS AND PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/742,033

(22) PCT Filed: Sep. 6, 2016

(86) PCT No.: PCT/JP2016/076205
§ 371 (c)(1),
(2) Date: Jan. 5, 2018

(87) PCT Pub. No.: WO2017/056878
PCT Pub. Date: Apr. 6, 2017

(65) Prior Publication Data

US 2018/0201025 A1 Jul. 19, 2018

(30) Foreign Application Priority Data

Sep. 30, 2015 (JP) ..... 2015-193473

(51) Int. Cl.
*B41J 2/21* (2006.01)
*B41J 2/15* (2006.01)
(Continued)

(52) U.S. Cl.
CPC ..... *B41J 2/2132* (2013.01); *B41J 2/15* (2013.01); *B41J 2/2054* (2013.01); *B41J 2/2103* (2013.01);
(Continued)

(58) Field of Classification Search
CPC ..... B41J 2/145; B41J 2/15
See application file for complete search history.

(56) References Cited

U.S. PATENT DOCUMENTS 6,299,287 B1 * 10/2001 Williams ..... B41J 19/147 347/15
2005/0035995 A1 * 2/2005 Yazawa ..... B41J 2/2132 347/43

FOREIGN PATENT DOCUMENTS

| | | |
|---|---|---|
| JP | H05131648 | 5/1993 |
| JP | 2000229424 | 8/2000 |
| JP | 2004352981 | 12/2004 |

OTHER PUBLICATIONS

Machine generated, English translation of JP2000-229424 to Gotou et al., "Inkjet Recorder and Recording Method"; translation retrieved via https://worldwide.espacenet.com on Sep. 25, 2018; 20pp.*
(Continued)

*Primary Examiner* — Shelby L Fidler
(74) *Attorney, Agent, or Firm* — JCIPRNET

(57) ABSTRACT

A printing apparatus includes six or more inkjet heads, a carriage that is a head holder to hold a plurality of inkjet heads, a main scanning driver, and a sub-scanning driver. The carriage dividedly holds a plurality of inkjet heads in a plurality of arrays including at least a first array in which a plurality of inkjet heads are disposed side by side in a main scanning direction, and a second array in which a plurality of inkjet heads are disposed side by side in the main scanning direction while being dislocated in a sub-scanning direction with respect to the first array. Merely not more than two inkjet heads in the first array ejects an ink droplet, and merely not more than two inkjet heads in the second array ejects an ink droplet with respect to a position of each pixel in a single time of a main scanning operation.

9 Claims, 12 Drawing Sheets

(51) Int. Cl.
*B41J 2/205* (2006.01)
*B41M 5/00* (2006.01)
*B41J 19/14* (2006.01)

(52) U.S. Cl.
CPC ..... *B41J 2/2107* (2013.01); *B41J 19/147* (2013.01); *B41M 5/0023* (2013.01)

(56) References Cited

OTHER PUBLICATIONS

"International Search Report (Form PCT/ISA/210) of PCT/JP2016/076205", dated Nov. 22, 2016, with English translation thereof, pp. 1-4.

* cited by examiner

PRINTING APPARATUS AND PRINTING METHOD

CROSS-REFERENCE TO RELATED APPLICATION

This application is a 371 application of the international PCT application serial no. PCT/JP2016/076205, filed on Sep. 6, 2016, which claims the priority benefits of Japan application no. 2015-193473, filed on Sep. 30, 2015. The entirety of each of the above-mentioned patent application is hereby incorporated by reference herein and made a part of this specification.

TECHNICAL FIELD

The present invention relates to a printing apparatus and a printing method.

BACKGROUND ART

Conventionally, inkjet printers that perform printing by inkjet technology have been widely used (refer to, for example, non-patent document 1). The inkjet printer prints a color image by using four color inks (Y, M, C, and K inks) of Y (yellow) color, M (magenta) color, C (cyan) color, and K (black). As these inks, for example, pigment inks are widely used. As a method of printing by an inkjet printer, a method of printing in serial mode is widely used which includes causing inkjet heads to perform a main scanning operation (scanning operation). In this case, in order to print a color image, individual color ink droplets are usually ejected onto a medium by using the inkjet heads for the individual colors of Y, M, C, and K aligned in a moving direction (main scanning direction) of the inkjet heads during the main scanning operation.

RELATED ART DOCUMENTS

Non-Patent Document

Non-patent document 1: Internet URL http://www.mimaki.co.jp

SUMMARY

Technical Problems

When printing a color image using the Y, M, C, and K inks, color expression with subtractive color process is usually carried out by causing ink droplets of a plurality of ink colors to land at an identical position on a medium. As used herein, an identical position denotes a position of each pixel set to printing resolution. Alternatively, this identical position may be, instead of a strictly identical position, any closely adjacent position in an allowable range according to resolution. In this case, a plurality of mutually different color ink droplets are landed on a single pixel position.

Also, when printing in serial mode, the inkjet heads respectively for the individual colors are usually disposed side by side in the main scanning direction as described above. Therefore, when causing a plurality of mutually different color ink droplets to land on the single pixel position, these ink droplets land on an identical position in a short period of time during the main scanning operation on an identical time.

On this occasion, however, various problems may occur due to an excessive ink amount landing on the identical position in the short period of time. More specifically, assuming that an ink amount necessary for solid printing (full solid printing) using one color ink is 100%, an ink ejection amount to the identical position on a medium reaches at most 400% when the Y, M, C, and K inks are used in a conventional inkjet printer configuration. It is conceivable that this ejection amount reaches approximately 200% on average.

In contrast, for example, when the ejection amount of the inks to the identical position is increased, bleeding between the inks is apt to occur. More specifically, for example, when the ink ejection amount to the identical position exceeds 120-150%, image quality of an image printed seems to degrade before the inks are fixed to the medium. Consequently, image quality of an image printed seems to degrade. Furthermore, for example, when using a paper medium or the like, curling and cockling are apt to occur due to influence of a solvent (such as water) in the inks.

In order to prevent the bleeding of the inks, it is also conceivable to form an ink image receiving layer on a medium, such as paper. In this case, however, any inexpensive media, such as plain papers, are unusable, so that running costs for the printing increases considerably. Hence, there has been a desire for a method capable of decreasing the ink ejection amount to each position on a medium. Accordingly, the present invention aims at providing a printing apparatus and a printing method which are capable of solving the above problems.

In recent years, it has been considered to use, as an ink intended for color expression by an inkjet printer, not only the three color inks of Y, M, and C, but also colors between these colors (for example, intermediate colors). Specifically, it has been considered to further use, as the intermediate color, inks of colors of, for example, R (red) color, G (green) color, and B (blue) color. More specifically, in this case, it is conceivable to carry out printing in seven-color separation mode (seven color separation method) that is a configuration using seven colors obtainable by adding three colors of R, G, and B to Y, M, C, and K. For example, higher definition printing is performable by printing in seven-color separation mode. Therefore, a method suitable when using these various inks is desirable as a method capable of reducing the ink ejection amount to each position on a medium.

Solutions to the Problems

The inventor of the present application conducted research and study on the method capable of reducing the ink ejection amount to each position on a medium. As to this method, more specifically, the inventor of the present application also considered a method suitable when further using color inks other than the three color inks of Y, M, and C (for example, individual color inks of R, G, and B) as an ink intended for the color expression.

Thus, the inventor of the present application focused on that the kinds of inks to be mixed for expressing a variety of different colors can be decreased by using an inkjet head for six colors or more including the individual colors of Y, M, and C, and R, G, and B than in the case of using only the inks of the individual colors of Y, M, and C. The inventor of the present application found, through further research and study, that this characteristic is useful for achieving a configuration capable of decreasing the number of colors of inks landed at an identical position in the main scanning operation on each time in association with a layout of inkjet heads for the individual colors. To solve the above-described problem, the present invention has the following configuration.

(Configuration 1) According to one aspect of the present invention, a printing apparatus for printing on a medium by inkjet technology is provided. The printing apparatus include six or more inkjet heads, a head holder, a main scanning driver, and a sub-scanning driver. The six or more inkjet heads are configured to eject mutually different color ink droplets by inkjet technology. The head holder is configured to hold the inkjet heads so as to be faced to the medium. The main scanning driver is configured to cause the inkjet heads to perform a main scanning operation to eject an ink droplet while moving relative to the medium in a preset main scanning direction. The sub-scanning driver is configured to cause the inkjet head to move relative to the medium in a sub-scanning direction orthogonal to the main scanning direction. The head holder is configured to dividedly hold the six or more inkjet heads in a plurality of arrays including at least a first array in which the inkjet heads are disposed side by side in the main scanning direction, and a second array in which the inkjet heads are disposed side by side in the main scanning direction while being dislocated in the sub-scanning direction with respect to the inkjet heads in the first array. Merely not more than two of the inkjet heads in the first array are configured to eject an ink droplet in a single time of the main scanning operation with respect to a position of each pixel set in a region of the medium which is faced to the inkjet heads in the first array. Merely not more than two of the inkjet heads in the second array are configured to eject an ink droplet in a single time of the main scanning operation with respect to a position of each pixel set in a region of the medium which is faced to the inkjet heads in the second array.

For example, when using the inks of six or more colors including individual colors of Y, M, and C, and R, G, and B, the kinds of inks to be mixed for expressing a variety of different colors can be appropriately reducible than the case of using only the three color inks of Y, M, and C. On this occasion, the number of inkjet heads that eject an ink droplet to an identical position during the main scanning operation on an identical time is appropriately reducible by dividedly disposing a plurality of inkjet heads in a plurality of arrays while being dislocated in the sub-scanning direction. Therefore, with this configuration, it is possible to, for example, appropriately reduce the ink ejection amount to each position on a medium.

In the above configuration, the inkjet heads disposed side by side in an identical array (each of the first array and the second array) are, for example, inkjet heads for a color which never perform ejection to a position of an identical pixel. A color ejected to the position of the identical pixel is, for example, a color mixed for expressing a variety of different colors. Here, the color mixed for expressing a variety of different colors is, for example, a color that is not mixed at least when minimizing the number of colors mixed.

In this case, by arranging so as to minimize the number of colors mixed at least at the position of the identical pixel, the inkjet heads disposed side by side in the identical array are the inkjet heads for colors which never simultaneously perform ejection to the position of the identical pixel. Here, simultaneously ejecting an ink droplet denotes, for example, ejecting an ink droplet during the main scanning operation on an identical time, namely, approximately simultaneously ejecting an ink droplet.

This configuration can be considered as, for example, a configuration in which the inkjet heads are disposed so that two or more color ink droplets do not simultaneously land on an identical position. On this occasion, as in a relationship, for example, between the inkjet heads in the first array and the inkjet heads in the second array, the inkjet heads disposed at different positions may simultaneously eject an ink droplet. In other words, even when the inkjet heads simultaneously eject an ink droplet, there is no problem as long as ink droplets do not overlappedly land at an identical position in the main scanning operation on an identical time.

During an actual printing, it is conceivable to eject an ink droplet to an identical position from two inkjet heads in an identical head array in order to make fine color adjustment or the like. Even in this case, the number of colors of ink droplets to be simultaneously landed at the identical position is preferably two colors or less. The number of colors of ink droplets to be simultaneously landed at the identical position is more preferably one color. With this configuration, the ink ejection amount to each position on a medium is appropriately reducible.

(Configuration 2) In the first aspect of the present invention, merely not more than one of the inkjet heads in the first array is configured to eject an ink droplet in a single time of the main scanning operation with respect to a position of each pixel set in a region facing the inkjet heads in the first array. Merely not more than one of the inkjet heads in the second array is configured to eject an ink droplet in a single time of the main scanning operation with respect to a position of each pixel set in a region facing the inkjet heads in the second array.

For example, when using the inks of six or more colors including the individual colors of Y, M, and C, and R, G, and B, it is possible to, in principle, express a variety of different colors by mixing inks of not more than two kinds of colors. Therefore, when using the inks of six or more colors including the individual colors of Y, M, and C, and R, G, and B, the number of the inkjet heads, which performs ejection to a position of an identical pixel in the main scanning operation on each time, is settable to one or more on a per-array basis, by dividedly disposing the inkjet heads into the first array and the second array. In this case, by shifting the position of the first array and the position of the second array in the sub-scanning direction it is possible to eliminate the possibility that the inkjet heads simultaneously eject an ink droplet to the position of an identical pixel. Therefore, with this configuration, the ink ejection amount to each position on a medium is more appropriately reducible.

(Configuration 3) In the first aspect of the present invention, each of the inkjet heads includes a nozzle array in which a plurality of nozzles are disposed side by side in the sub-scanning direction, and the inkjet heads in the second array are disposed side by side in the main scanning direction while being dislocated in the sub-scanning direction with respect to the inkjet heads in the first array by a distance not less than a length of the nozzle array of the inkjet head in the first array. With this configuration, for example, the inkjet heads in the first array and the inkjet heads in the second array can be appropriately dislocated in the sub-scanning direction. This makes it possible to more appropriately reduce the ink ejection amount to each position on a medium.

(Configuration 4) In the first aspect of the present invention, the six or more inkjet heads include three first basic color heads that are three inkjet heads respectively configured to eject an ink droplet of three kinds of primary colors for performing color expression, and three second basic color heads that are three inkjet heads respectively configured to eject an ink droplet of a color between two colors of the three kinds of primary colors.

The three first basic color heads are respectively, for example, the inkjet heads for the individual colors of Y, M, and C. The three second basic color heads are respectively, for example, the individual colors of R, G, and B. With this configuration, a variety of different colors can be expressed appropriately with high definition by, for example, the six color inks. In this case also, the ink ejection amount to each position on a medium is more appropriately reducible by dividedly disposing the inkjet heads for the individual colors into the first array and the second array, or the like.

When considered in a more generalized manner, the color between two colors of the three kinds of primary colors may be any color between two colors of three primary colors without limiting to the individual colors of R, G, and B. In this case, the color between two colors may be any color expressed by mixing two colors. It is also conceivable to use any color other than Y, M, and C, as the three kinds of primary colors.

(Configuration 5) In the first aspect of the present invention, the three first basic color heads are respectively configured to eject an ink droplet of individual colors of Y (yellow) color, M (magenta) color, and C (cyan) color, and the three second basic color heads are respectively configured to eject an ink droplet of individual colors of R (red) color, G (green) color, and B (blue) color. With this configuration, a variety of different colors can be expressed more appropriately with higher definition by, for example, the six color inks.

(Configuration 6) In the first aspect of the present invention, the six or more inkjet heads further include a black color head that is an inkjet head configured to eject an ink droplet of black color, and the head holder holds the black color head while being dislocated in the sub-scanning direction with respect to both of the three first basic color heads and the three second basic color heads.

With this configuration, the individual colors including black color can be more appropriately expressed by using the black color head. The black color ink may be ejected to an identical position on a medium with respect to each of color inks. In this regard, with this configuration, the black color head is held while being dislocated in the sub-scanning direction with respect to each of the three first basic color heads and the three second basic color heads. Therefore, this configuration is capable of appropriately preventing that the black color head ejects an ink droplet to an identical position together with other inkjet heads in the main scanning operation on an identical time. This makes it possible to more appropriately reduce the ink ejection amount to each position on the medium.

(Configuration 7) In the first aspect of the present invention, the head holder is configured to hold the three first basic color heads side by side in the first array, and hold the three second basic color heads side by side in the second array.

When a color between two colors of the three kinds of primary colors (for example, the individual colors of R, G, and B) are used in addition to the three primary colors (for example, the individual colors of Y, M, and C), a variety of different colors can be appropriately expressed by making neither a color mixing between ink colors used in the three first basic color heads (for example, a color mixing between Y, M, and C), nor a color mixing between ink colors used in the three second basic color heads (for example, a color mixing between R, G, and B). Therefore, for example, this configuration is capable of appropriately decreasing the number of the inkjet heads which perform ejection to an identical position in the main scanning operation on each time. This makes it possible to more appropriately reduce the ink ejection amount to each position on a medium.

(Configuration 8) In the first aspect of the present invention, the head holder is configured to dividedly hold the six or more inkjet heads in a plurality of arrays including at least the first array, the second array, and a third array in which a plurality of the inkjet heads are disposed side by side in the main scanning direction while being dislocated in the sub-scanning direction with respect to the inkjet heads in the first array and the inkjet heads in the second array. One of the first basic color heads and one of the second basic color heads are disposed side by side in the main scanning direction at least in one of the first array, the second array, and the third array. A color of an ink droplet ejected from the one second basic color head is a color between two colors of the three kinds of primary colors, except for a color of an ink droplet ejected from the one first basic color head.

With this configuration, for example, the six or more inkjet heads can be appropriately dividedly disposed in a plurality of arrays. This follows that the first basic color heads and the second basic color heads are disposed side by side in the main scanning direction in one of the arrays. In this regard, this configuration makes it possible to select the inkjet head for a color which needs not be mixed for expressing a variety of different colors, in association with the first basic color heads and the second basic color heads disposed side by side in this array. Hence, for example, this configuration is capable of more appropriately reducing the ink ejection amount to each position on a medium.

(Configuration 9) In the first aspect of the present invention, the printing apparatus is configured to enable setting, as a printing mode performed in the printing apparatus, a first printing mode for printing using both of a plurality of inkjet heads disposed side by side in the first array and a plurality of inkjet heads disposed side by side in the second array, and a second printing mode for performing printing using a plurality of inkjet heads disposed side by side in the first array without using a plurality of inkjet heads disposed side by side in the second array.

With this configuration, the number of the inkjet heads used during printing is appropriately changeable, for example, according to desired printing quality or the like. In this case, it is conceivable to select, for example, the inkjet heads of the individual colors of Y, M, and C or the individual colors of Y, M, C, and K, as inkjet heads disposed side by side in the first array. This configuration makes it possible to more appropriately obtain, for example, color reproducibility similar to that in, for example, a printing apparatus having the conventional configuration which performs printing using the inks of the individual colors of Y, M, C, and K. This makes it possible to more appropriately achieve, for example, high compatibility with the conventional printing apparatus.

(Configuration 10) According to another aspect of the present invention, a printing method for printing on a medium by inkjet technology is provided. The method include: holding six or more inkjet heads configured to eject mutually different color ink droplets by inkjet technology while being faced to the medium; causing the inkjet heads to perform a main scanning operation to eject an ink droplet while moving relative to the medium in a preset main scanning direction, and an operation to move relative to the medium in a sub-scanning direction orthogonal to the main scanning direction; dividedly holding the six or more inkjet heads in a plurality of arrays including at least a first array in which the inkjet heads are disposed side by side in the main scanning direction, and a second array in which the inkjet heads are disposed side by side in the main scanning direction while being dislocated in the sub-scanning direction with respect to the inkjet heads in the first array; causing merely not more than two of the inkjet heads in the first array to eject an ink droplet in a single time of the main scanning operation with respect to a position of each pixel set in a region of the medium which is faced to the inkjet heads in the first array; and causing merely not more than two of the inkjet heads in the second array to eject an ink droplet in a single time of the main scanning operation with respect to a position of each pixel set in a region of the medium which is faced to the inkjet heads in the second array. With this configuration, for example, an effect similar to that in Configuration 1 is obtainable.

(Configuration 11) According to still another aspect of the present invention, a printing apparatus for printing on a medium by inkjet technology is provided. The printing apparatus includes six or more inkjet heads, a head holder, and a main scanning driver. The six or more inkjet heads are configured to eject mutually different color ink droplets by inkjet technology. The head holder is configured to hold the inkjet heads so as to face the medium. The main scanning driver is configured to cause the inkjet heads to perform a main scanning operation to eject an ink droplet while moving relative to the medium in a preset main scanning direction. The head holder is configured to dividedly hold the six or more inkjet heads in a plurality of groups including at least a first group and a second group in each of which the inkjet heads are disposed side by side in the main scanning direction. The printing apparatus is configured to enable setting, as a printing mode performed in the printing apparatus, a first printing mode for printing using both of a plurality of inkjet heads disposed side by side in the first group and a plurality of inkjet heads disposed side by side in the second group, and a second printing mode for performing printing using a plurality of inkjet heads disposed side by side in the first group without using a plurality of inkjet heads disposed side by side in the second group.

With this configuration, the number of the inkjet heads used during printing is appropriately changeable, for example, according to desired printing quality or the like. In this case, it is conceivable to select, for example, the inkjet heads of the individual colors of Y, M, and C or the individual colors of Y, M, C, and K, as inkjet heads disposed side by side in the first group. With this configuration, for example, when printing in the first printing mode, it possible to appropriately obtain, for example, color reproducibility similar to, for example, the printing apparatus having the conventional configuration which performs printing using the inks of the individual colors of Y, M, C, and K. This also makes it possible to more appropriately achieve, for example, high compatibility with the conventional printing apparatus.

(Configuration 12) According to yet another aspect of the present invention, a printing method for printing on a medium by inkjet technology is provided. The method includes: holding six or more inkjet heads configured to eject mutually different color ink droplets by inkjet technology while being faced to the medium; causing the inkjet heads to perform a main scanning operation to eject an ink droplet while moving relative to the medium in a preset main scanning direction; dividedly holding the six or more inkjet heads in a plurality of arrays including at least a first group and a second group in each of which the inkjet heads are disposed side by side in the main scanning direction; and enabling setting, as a printing mode executed, a first printing mode for printing using both of a plurality of inkjet heads disposed side by side in the first group and a plurality of inkjet heads disposed side by side in the second group, and a second printing mode for performing printing using a plurality of inkjet heads disposed side by side in the first group without using a plurality of inkjet heads disposed side by side in the second group. With this configuration, for example, an effect similar to that in Configuration 11 is obtainable.

Effects of the Invention

According to the present invention, for example, the ink ejection amount to each position on a medium is appropriately reducible.

BRIEF DESCRIPTION OF THE DRAWINGS

FIG. 2A and FIG. 2B are diagram illustrating the configurations of a conventional head 12 and the like. FIG. 2A is a diagram illustrating an exemplary configuration of the conventional head 12, and illustrating, together with a carriage 14, an exemplary configuration of a head 12 typically used when using four color inks of Y (yellow), M (magenta), C (cyan), and K (black) in a serial inkjet printer. FIG. 2B illustrates an exemplary configuration of the head 12 when using seven color inks, together with the carriage 14.

FIG. 5A is a diagram describing a relationship between ink colors used in YMC mode. FIG. 5B is a diagram illustrating an exemplary configuration of the head 12 used when printing in YMC mode. FIG. 5C illustrates an exemplary configuration in which the inkjet heads 102*y* to 102*k* are disposed side by side in a sub-scanning direction.

FIG. 6A is a diagram describing a relationship between ink colors used in seven-color separation mode. FIGS. 6B to 6D are diagrams illustrating various exemplary configurations of the head 12 in the present embodiment. FIG. 6E is a diagram illustrating an exemplary layout of inkjet heads used in seven-color separation mode.

FIG. 11A is a diagram describing color reproducibility when using an ideal ink different from an actual ink. FIG. 11B illustrates exemplary color reproducibility when using the actual ink.

FIGS. 12A and 12B respectively illustrate modifications of the configuration of the head 12.

DESCRIPTION OF EMBODIMENTS

Figure 1:
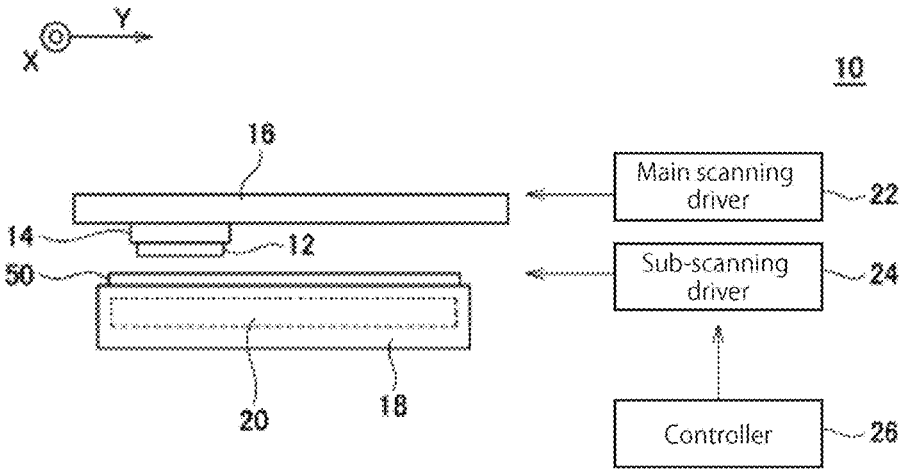
FIG. 1 is a diagram illustrating the configuration of a printing apparatus 10 according to one embodiment of the present invention.

Hereinafter, an embodiment of the present invention will be described with reference to the drawings. FIG. 1 illustrates the configuration of a printing apparatus 10 according to an embodiment of the present invention. The printing apparatus 10 of this embodiment may have a characteristic feature identical or similar to a well-known inkjet printer, except for a point described below.

The printing apparatus 10 is an inkjet printer that carries out color printing by inkjet technology using a plurality of color inks, and expresses a variety of different colors by ejecting ink droplets of a plurality of colors to positions of individual pixels in a printing object medium 50 so as to mix the plurality of color inks at the positions of the individual pixels. In this embodiment, the printing apparatus 10 is the inkjet printer that performs printing in serial mode designed to cause inkjet heads to perform a main scanning operation (scanning operation). The printing apparatus 10 includes a head 12, a carriage 14, a guide rail 16, a platen 18, a heater 20, a main scanning driver 22, a sub-scanning driver 24, and a controller 26. As used herein, the main scanning operation denotes, for example, an operation of ejecting an ink droplet while relatively moving with respect to the medium 50 in a preset main scanning direction (Y direction in the diagram). In this case, it is conceivable that the main scanning direction is a moving direction of the inkjet heads during the main scanning operation.

The head 12 is a section that ejects an ink droplet toward the medium 50, and includes a plurality of inkjet heads designed to eject different color ink droplets by inkjet technology. More specifically, the head 12 includes six or more inkjet heads in this embodiment. In this case, the head 12 preferably includes six or more inkjet heads, each of which ejects a chromatic ink droplet. As used herein, the chromatic ink droplet is, for example, an ink droplet of color inks for coloring used for expressing a variety of different colors.

In this embodiment, these inkjet heads eject an ink droplet of ink to be fixed to the medium 50 by volatilizing and removing a solvent. As used herein, the ink to be fixed to the medium 50 by volatilizing and removing a solvent refers to, for example, an aqueous ink. It is also conceivable to use, as this ink, for example, a solvent ink and a latex ink.

Alternatively, any ink other than the ink to be fixed to the medium 50 by volatilizing and removing a solvent may be used in each of the inkjet heads of the head 12. It is also conceivable to use, for example, UV curable inks (UV inks) and solvent-containing UV inks (solvent UV inks, SUV inks). A layout and the like of the inkjet heads in the head 12 are described in detail later.

The carriage 14 is an exemplary head holder and holds the inkjet heads in the head 12 so as to face the medium 50. The guide rail 16 is a rail to guide movement of carriage 14 in the main scanning direction.

The platen 18 is a platform-shaped member to hold the medium 50 so as to face the head 12. The heater 20 is an exemplary fixing means for fixing ink to the medium 50, and volatilizes and removes the solvent contained in the ink on the medium 50 by heating the medium 50.

The fixing means for fixing the ink to the medium 50 is not limited to a specific means, but it is conceivable to use various means according to an ink used. In association with a method of drying the ink, it is also conceivable to carry out pre-drying and post-drying, and pre-processing and post-processing of the medium 50. More specifically, in order to facilitate the fixing of the ink to the medium 50, it is conceivable to use the medium 50 having an image receiving layer and a pre-processing layer formed thereon. It is also conceivable to further use, as the heater 20, besides the heater to heat the medium 50 at a position opposite to the head 12, for example, a heater for post-heating and drying, which heats the medium 50 after the ink is landed thereon.

When using an ink other than the ink designed to be fixed to the medium 50 by volatilizing and removing a solvent, the printing apparatus 10 may include a fixing means other than the heater 20, according to an ink used. For example, when using the UV curable ink, a UV light source (for example, a UVLED) instead of the heater 20. It is also conceivable to use a fixing means for causing ink to cure by electron beam, depending on the kind of an ink used. For example, when using the solvent UV ink, it is conceivable to use the heater 20 and a UV light source as the fixing means.

The main scanning driver 22 is a driver that causes the inkjet heads in the head 12 to perform the main scanning operation. In this embodiment, the main scanning driver 22 causes the individual inkjet heads to perform the main scanning operation in the head 12 by causing the individual inkjet heads to eject an ink droplet while causing the carriage 14 to move along the guide rail 16.

The sub-scanning driver 24 is a driver that causes the inkjet head to move relative to the medium 50 in a sub-scanning direction (X direction in the diagram) orthogonal to the main scanning direction. In this embodiment, the sub-scanning driver 24 causes the inkjet heads in the head 12 to move relative to the medium 50 by transporting the medium 50 in the sub-scanning direction with the use of, for example, a roller (not illustrated). The sub-scanning driver 24 also causes the inkjet heads in the head 12 to perform the sub-scanning operation so as to sequentially change a region of the medium 50 which is faced to the head 12, by transporting the medium 50 in between the main-scanning operations. Therefore, the sub-scanning direction is a direction parallel to a transport direction of the medium 50 (medium movement direction) in this embodiment.

The controller 26 is, for example, a CPU of the printing apparatus 10, and controls operations of individual components of the printing apparatus 10. With this embodiment, printing on the medium 50 is appropriately performable.

The layout and the like of the inkjet heads in the head 12 are described in more detail below. For the sake of description, exemplary configurations of the conventional head 12 and the like are described first.

Figure 2A:
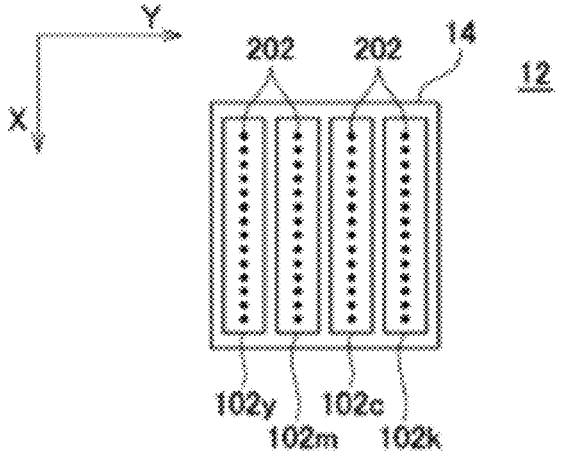
Figure 2B:
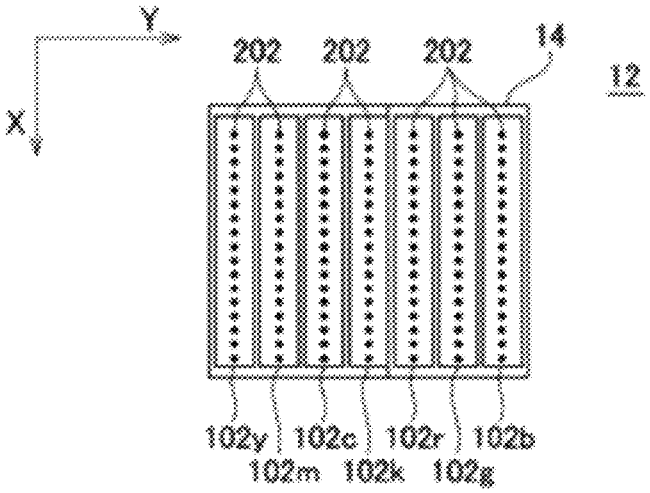

FIG. 2A and FIG. 2B are diagrams illustrating the configurations of the conventional head 12 and the like. FIG. 2A is a diagram illustrating an exemplary configuration of the conventional head 12, and illustrating, together with the carriage 14, an exemplary configuration of the head 12 typically used when using four color inks of Y (yellow), M (magenta), C (cyan), and K (black) in a serial inkjet printer.

In this case, the head 12 includes, for example, an inkjet head 102*y* to eject an ink droplet of Y color, an inkjet head 102*m* to eject an ink droplet of M color, an inkjet head 102*c* to eject an ink droplet of C color, and an inkjet head 102*k* to eject an ink droplet of K color. These inkjet heads 102*y* to

102*k* include a nozzle array 202 having a plurality of nozzles disposed side by side in the sub-scanning direction, and are, for example, disposed side by side in the main scanning direction as illustrated in the diagram. Thus, these inkjet heads 102*y* to 102*k* eject an ink droplet onto an identical region (band region) on the medium 50 in the main scanning operation on each time.

It is also conceivable to further use three color inks of, for example, R (red), G (green), and B (blue) in addition to the four colors of Y, M, C, and K in the head 12. FIG. 2B illustrates an exemplary configuration of the head 12 when using seven color inks, together with the carriage 14.

In this case, the head 12 further includes, besides the inkjet heads 102*y* to 102*k*, an inkjet head 102*r* to eject an ink droplet of R color, an inkjet head 102*g* to eject an ink droplet of G color, and an inkjet head 102*b* to eject an ink droplet of B color. Similarly to the inkjet heads 102*y* to 102*k*, these inkjet heads 102*r* to 102*b* also include a nozzle array 202 having a plurality of nozzles disposed side by side in the sub-scanning direction. These inkjet heads 102*y* to 102*k* and 102*r* to 102*b* are, for example, disposed side by side in the main scanning direction as illustrated in the diagram.

Figure 3:
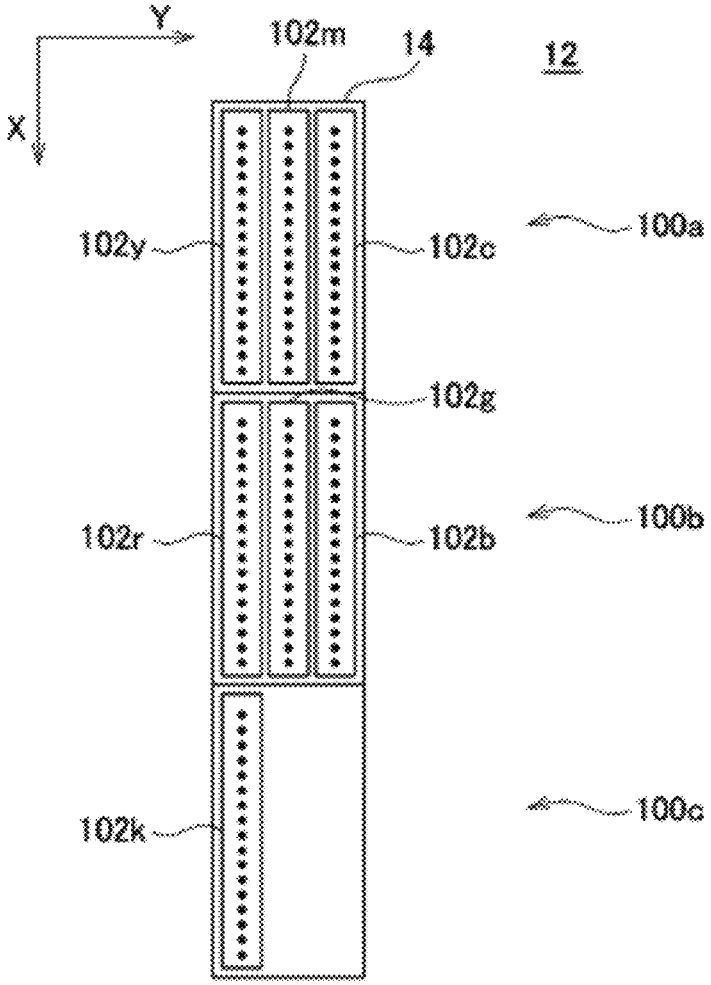
FIG. 3 is a diagram illustrating an exemplary configuration of the head 12 in the present embodiment, together with the carriage 14.

Whereas the head 12 of this embodiment differs from the conventional configuration in layout of inkjet heads. FIG. 3 illustrates an exemplary configuration of the head 12 in this embodiment, together with the carriage 14.

In this embodiment, the head 12 includes a plurality of inkjet heads 102*y* to 102*k*, and 102*r* to 102*b* for seven colors as in the case illustrated in FIG. 2B. For example, well-known inkjet heads are suitably usable as the inkjet heads 102*y* to 102*k*, and 102*r* to 102*b*. Each of the inkjet heads 102*y* to 102*k*, and 102*r* to 102*b* may have the characteristic feature identical or similar to that of the individual inkjet heads described with reference to FIG. 2A and 2B. For example, each of the inkjet heads 102*y* to 102*k*, and 102*r* to 102*b* has a nozzle array having a plurality of nozzles disposed side by side in the sub-scanning direction. Each of the inkjet heads 102*y* to 102*k*, and 102*r* to 102*b* may be an inkjet head of identical shape.

The inkjet heads 102*y* to 102*k*, and 102*r* to 102*b* are exemplary of the six or more inkjet heads. Of the inkjet heads 102*y* to 102*k*, and 102*r* to 102*b*, the inkjet heads 102*y* to 102*c*, and 102*r* to 102*b*, except for the inkjet head 102*k* for K color, respectively eject a chromatic ink droplet of individual colors. The carriage 14 holds these inkjet heads 102*y* to 102*k*, and 102*r* to 102*b* in a different layout from that illustrated in FIG. 2B.

More specifically, in this embodiment, the carriage 14 dividedly holds the inkjet heads 102*y* to 102*k*, and 102*r* to 102*b* in a plurality of head arrays 100*a* to 100*c* whose positions relative to the sub-scanning direction are shifted to each other. Here, the head array is, for example, an array in which a plurality of inkjets are disposed side by side in the main scanning direction. In this case, the inkjet heads are preferably disposed side by side by aligning positions of the nozzle arrays in the sub-scanning direction. The head array 100*a* is an exemplary first array in which a plurality of inkjet heads are disposed side by side in the main scanning direction. The head array 100*b* is an exemplary second array in which a plurality of inkjet heads are disposed side by side while being dislocated in the sub-scanning direction with respect to the inkjet heads in the first array.

A plurality of inkjet heads are disposed side by side in the main scanning direction while being disposed side by side in the sub-scanning direction in each of the head arrays 100*a* and 100*b*. A single inkjet head is disposed in the head array 100*c*. The inkjet heads in each of the head arrays 100*a* to 100*c* are disposed while being dislocated in the sub-scanning direction by a distance not less than a length of a nozzle array of the inkjet heads in each of the head arrays (a width corresponding to the nozzle array) with respect to the inkjet heads in another head array. As used herein, being disposed while being dislocated in the sub-scanning direction by a distance not less than the length of the nozzle array denotes, for example, being disposed so that positions of the inkjet heads of different head arrays in the sub-scanning direction are not overlapped one another. More specifically, for example, the inkjet heads in the head array 100*b* are disposed side by side in the main scanning direction while being dislocated in the sub-scanning direction by a distance not less than the length of the nozzle array of the inkjet heads in the head array 100*a*, with respect to the inkjet heads in the head array 100*a*. With this configuration, for example, the positions of the inkjet heads in each of the head arrays 100*a* to 100*c* in the sub-scanning direction can appropriately be dislocated with respect to the inkjet heads in other head arrays.

As used herein, the length of the nozzle array of the inkjet heads in each of the head arrays denotes the length of the nozzle array in the sub-scanning direction. The inkjet heads in each of the head arrays preferably have, for example, the nozzle array of identical length. As used herein, the length of the nozzle array of the inkjet heads of each of the head arrays may be the length of the nozzle array of any one of the inkjet heads in the head array. At least a part of the inkjet heads in each of the head arrays may have a nozzle array that differs from other inkjet heads in length. Here, the length of the nozzle array of the inkjet heads in each of the head arrays may be a length of the longest nozzle array in the head array.

In this embodiment, the carriage 14 holds, from among the inkjet heads in the head 12, the inkjet heads 102*y* to 102*c* respectively for the individual colors of Y, M, and C, in a state of being disposed side by side in the head array 100*a*. The carriage 14 also holds the inkjet heads 102*r* to 102*b* for the individual colors of R, G, and B in a state of being disposed side by side in the head array 100*b*.

The head 12 further includes the inkjet head 102*k* for back color, in addition to the inkjet heads 102*y* to 102*k* and the inkjet heads 102*r* to 102*b*. The inkjet head 102*k* is an exemplary head for black color which is the inkjet head to eject an ink droplet of black color. In this embodiment, the carriage 14 holds the inkjet head 102*k* in the head array 100*c*. Thus, the carriage 14 holds the inkjet head 102*k* while being dislocated in the sub-scanning direction with respect to each of the inkjet heads 102*y* to 102*k* and the inkjet heads 102*r* to 102*b*.

The inkjet heads 102*y* to 102*c* are exemplary three first base color heads that are three inkjet heads to respectively eject ink droplets of three kinds of primary colors for performing color expression. The inkjet heads 102*r* to 102*b* are exemplary three second base color heads that are three inkjet heads to respectively eject an ink droplet of a color between two colors of the three kinds of primary colors. The use of these six color inks makes it possible to, for example, appropriately express a variety of different colors with high definition.

When considered in a more generalized manner, the color between two colors of the three kinds of primary colors may be any color between two colors of the three primary colors without limiting to the individual colors of R, G, and B. In this case, the color between two colors may be any color expressed by mixing two colors. It is also conceivable to use any colors other than Y, M, and C as the three kinds of primary colors.

In this embodiment, the inkjet heads are members each having the nozzle array that ejects an ink droplet of one color in the head 12. Each of the inkjet heads may have a plurality of nozzle arrays to eject an ink droplet of identical color. When a plurality of nozzle arrays are disposed in one member and these nozzle arrays eject mutually different color ink droplets, the one member can be regarded as a member functioning as a plurality of inkjet heads.

Effects and the like obtainable from the configuration of this embodiment are described below. With this embodiment, an ink ejection amount to each position on the medium 50 is reducible by using the inkjet heads 102*r* to 102*b* in addition to the inkjet heads 102*y* to 102*k*. As used herein, the ink ejection amount to each position on the medium 50 denotes an ink ejection amount ejected to each position, for example, in solid printing for filling at a predetermined concentration. The ink ejection amount simultaneously ejected to each position is further reducible by, for example, disposing the inkjet heads side by side as illustrated in FIG. 3. As used herein, the ejection amount of the inks simultaneously ejected to each position denotes, for example, an ink ejection amount ejected to an identical position in a single time of the main scanning operation.

Figure 4:
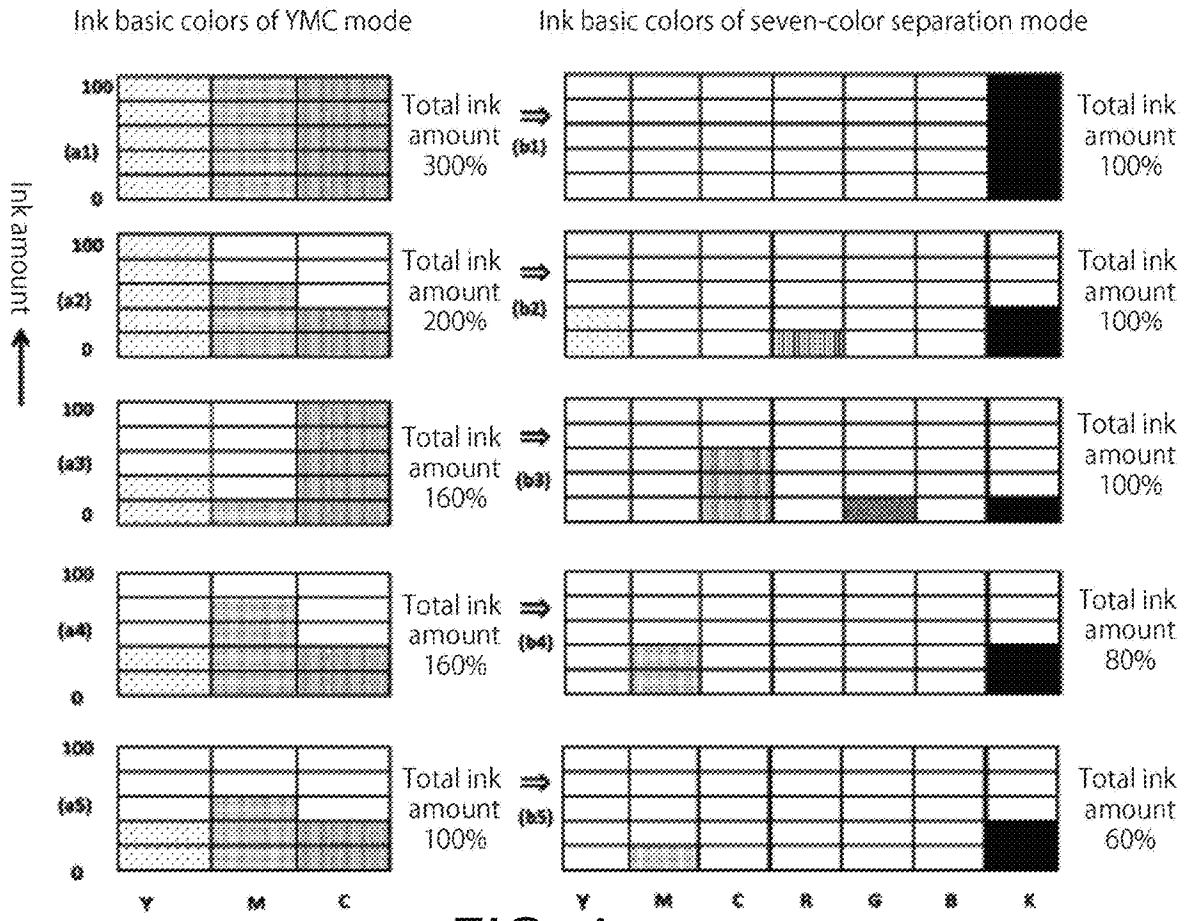
FIG. 4 is a diagram describing effects owing to the use of inkjet heads 102*r* to 102*b* in addition to inkjet heads 102*y* to 102*k*.

FIG. 4 is a diagram describing effects owing to the use of inkjet heads 102*r* to 102*b* in addition to the inkjet heads 102*y* to 102*k*. In the diagram, YMC mode denotes a mode of carrying out color printing without using the individual colors of R, G, and B, for example, as in the case of using only the individual colors of Y, M, C, and K. Seven-color separation mode is a mode of carrying out color printing using the individual colors of R, G, and B in addition to the individual colors of, Y, M, C, and K. The seven-color separation mode can be considered as, for example, an exemplary mode of using chromatic inks of seven colors or more.

FIG. 4 also illustrates by comparing an ink ejection amount when expressing an identical color (during identical color reproduction) in YMC mode and that in seven-color separation mode. More specifically, when printing in YMC mode, expressions of colors as indicated by (a1), (a2), (a3), (a4), and (a5) in the diagram respectively need the ink ejection amounts of 300%, 200%, 160%, 160%, and 100%. As used herein, the ejection amount of 100% corresponds to the ink amount when solid printing is carried out with one color ink.

In contrast, when printing in seven-color separation mode, the ink ejection amount is considerably reducible so as to reduce a maximum ink ejection amount to 100% or less by using the individual color inks of R, G, and B. More specifically, when the printing in seven-color separation mode is applied for expressing the colors respectively identical to (a1), (a2), (a3), (a4), and (a5) as in the case of printing in YMC mode, the ink ejection amount (a total ink amount) is reducible to 100% or less in every case, for example, as indicated by (b1), (b2), (b3), (b4), and (b5) in the diagram.

More specifically, assuming that when printing is carried out using the individual color inks of Y, M, and C at a concentration of 100% in the case of printing in YMC mode, the weight of each color ink is 1, and the weights of the inks when the printing is carried out actually with the individual colors are indicated by x, y, and z, the x, y, and z are respectively a value between 0 and 1, and a relationship of $0 \le x, y, x \le 1$ is established. Assuming that the amounts of inks of the individual colors of Y, M, C, K, R, G, and B in seven-color separation mode when expressing the same colors as in YMC mode are Y', M', C', R', G', B', and k', relationships between x, y, and z, and Y', M', C', R', G', B', and k' are as follows.

When $x \ge y \ge z$, $Y'=x-y$, $R'=y-z$, and $k'=z$

When $x \ge z \ge y$, $Y'=x-z$, $G'=z-y$, and $k'=y$

When $y \ge z \ge x$, $M'=y-z$, $B'=z-x$, and $k'=x$

When $y \ge x \ge z$, $M'=y-x$, $R'=x-z$, and $k'=z$

When $z \ge x \ge y$, $C'=z-x$, $G'=x-y$, and $k'=y$

When $z \ge y \ge x$, $C'=z-y$, $B'=y-x$, and $k'=x$

As can be seen from these relationships, in every case, the total amount of each of the three inks is equal to the maximum ink ejection amount in YMC mode, namely, a value of 100% or less. In other words, all of the colors can be expressed by reducing the ink ejection amount to 100% or less with the use of seven-color separation mode. Consequently, the ink ejection amount is reducible to, on average, approximately half of that in YMC mode. The maximum ink ejection amount of each color is equal to the maximum value in YMC mode.

The effect of decreasing the ink amount obtainable by printing in seven-color separation mode can also be described by dissecting the ink colors into, for example, a primary color, a secondary color, a tertiary color. Of the individual colors illustrated in FIG. 4, for example, the individual colors of Y, M, and C correspond to the primary color, the individual colors of R, G, and B correspond to the secondary color, and K color corresponds to the tertiary color. When printing in seven-color separation mode, only one of the primary colors appears at an identical position as illustrated in the diagram. This is because a component composed of two colors is converted to the secondary color, and a component composed of three colors is converted to the tertiary color.

As a result, for example, in the case illustrated as (b1 ) in the diagram, a total primary color ink that is a total amount of the primary color inks, and a total secondary ink that is a total amount of the secondary color inks are both 0%. A total tertiary color ink that is a total amount of the tertiary color ink is 100%. Accordingly, a total ink amount that is a total of these is 100%.

In the case illustrated as (b2 ), a total primary color ink, a total secondary color ink, and a total tertiary color ink are respectively 40%, 20%, and 40%. A total ink amount is 100%. In the case illustrated as (b3 ), a total primary color ink, a total secondary color ink, and a total tertiary color ink are respectively 60%, 20%, and 20%. A total ink amount is 100%. In the case illustrated as (b4 ), a total primary color ink, a total secondary color ink, and a total tertiary color ink are respectively 40%, 0%, and 40%. A total ink amount is 80%. In the case illustrated as (b5), a total primary color ink, a total secondary color ink, and a total tertiary color ink are respectively 20%, 0%, and 40%. A total ink amount is 60%.

As can be seen from the foregoing specific embodiment, all of the colors can be expressed by reducing the total ink amount to 100% or less when printing in seven-color separation mode. On this occasion, the total ink amount is reducible, on average, approximately half of the case of printing in YMC mode. The maximum ink amount becomes identical to that in printing in YMC mode.

In FIG. 4, for the sake of description, YMC mode is described as a mode of performing printing with three colors not using black ink (three-color separation mode). Consequently, a difference in ink ejection amount when YMC mode and seven-color separation mode are compared is expressed in a further enlarged size. More specifically, the ink ejection amount is greatly reducible to one third by setting one color, namely, K color to 100% in seven-color separation mode, for example, in the case where an ink ejection amount is 300% (a total reaches 300% when each color of Y, M, and C is 100%) as in the case of the relationship between (a1) and (b1) in the diagram. However, as apparent from the entirety of FIG. 4 and the principles of color expressions with a plurality of color inks, it is clear that the use of the individual color inks of R, G, and B makes it possible to decrease the ink ejection amount than in YMCK mode, regardless of the effect owing to the use of the black ink in seven-color separation mode. For example, when printing a normal full color image, it seems possible to reduce, on average, not less than 40% of ink amount. Additionally, the amount of use of ink decreases when printing in seven-color separation mode as described above. It is therefore conceivable that seven-color separation mode has the configuration capable of reducing, for example, running costs of the printing apparatus 10.

In this embodiment, the ink ejection amount simultaneously ejected to an identical position is decreased by, for example, disposing the inkjet heads side by side as illustrated in FIG. 3, in addition to the use of the individual color inks of R, G, and B. More specifically, as understandable from the matters described above, it can be said that when focusing on each of the primary color, the secondary color, and the tertiary color in the printing in seven-color separation mode, two color inks are never ejected to an identical position. Hence, for example, even when a plurality of inkjet heads for the primary color, and a plurality of inkjet heads for the secondary color are disposed side by side in the main scanning direction (on an identical Y axis), no ink droplet is ejected to an identical position in the main scanning operation on an identical time. Consequently, it seems that this layout cannot cause bleeding.

In this embodiment, the ink amount simultaneously ejected to an identical position is further reducible by determining a layout of the inkjet heads using this nature in seven-color separation mode. More specifically, as described above with reference to FIG. 3, the inkjet heads are dividedly disposed in three arrays of the primary colors (Y, M, and C), the secondary colors (R, G, and B), and the tertiary color (K) while being dislocated in the sub-scanning direction.

In this case, as indicated as (b1), (b2), (b3), (b4), and (b5) in FIG. 4, the total ink amount in each of the primary color, the secondary color, and the tertiary color (each of the total primary color ink, the total secondary color ink, and the total third color ink) is considerably decreased than the total ink amount in YMC mode. For example, when a comparison is made between 200% that is the ink amount ejected to an identical position in the case indicated as (a2) in FIG. 4, and 40% that is the maximum ink amount ejected to an identical position in the case indicated as (b2), the ink amount is reduced to one fifth.

From the foregoing point, the configuration of this embodiment can also be said to be a configuration by which bleeding is further less likely to occur, even when compared with, for example, the case of printing in seven-color separation mode with a simple configuration. Accordingly, it can also be said to be a configuration suitable for speeding up printing. This point is described in more detail below. For the sake of description, the case of expressing a variety of different colors in YMC mode is described first.

Figure 5A:
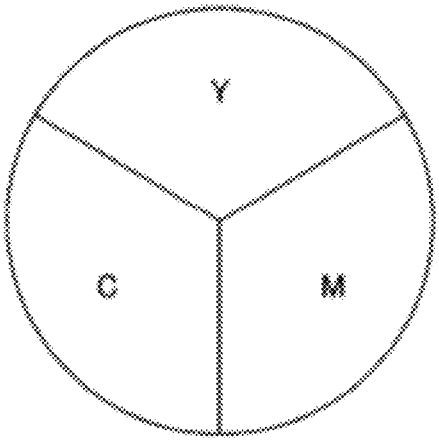
FIGS. 5A to 5C are diagrams describing the configuration of the head 12 when printing in YMC mode.
Figure 5B:
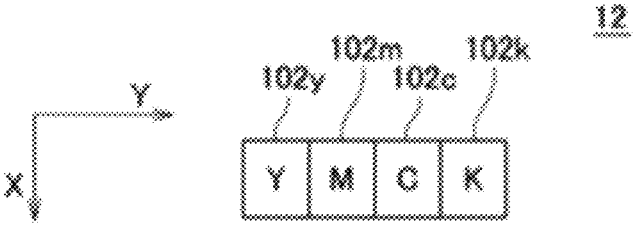

FIG. 5A and 5B are diagrams describing the configuration of the head 12 when printing in YMC mode. FIG. 5A is a diagram describing a relationship between ink colors used in YMC mode. FIG. 5B is a diagram illustrating an exemplary configuration of the head 12 used when printing in YMC mode, and illustrates the configuration of the head 12 illustrated in FIG. 2A in a simplified form.

As described above, when printing in YMC mode, the individual color inks of Y, M, and C are used as the three kinds of primary colors for performing color expressions. A variety of different colors are expressed by mixing these inks at different ratios on a medium. On this occasion, mixing the individual inks on the medium may be, for example, forming dots of the individual color inks at an identical position on the medium. The identical position on the medium denotes a position of each pixel set according to resolution of printing.

In this case, when the colors of inks used for printing are disposed side by side in a color space, for example, the individual colors of Y, M, and C have a relationship of being adjacent to each other as illustrated in FIG. 5A. Therefore, in order to express all colors with the three colors of Y, M, and C, two colors or three colors are ejected in a combination of Y+M, M+C, C+Y, and Y+M+C to the identical position on the medium. On this occasion, when the head 12 having the conventional configuration as illustrated in FIG. 5B, ink droplets of a plurality of color inks are simultaneously ejected to the identical position on the medium in the main scanning operation on an identical time. As a result, the ink ejection amount to each position of the medium may be increased. In this case, bleeding or the like is apt to occur due to the increased ink ejection amount.

More specifically, for example, bleeding between the inks is apt to occur due to the increased ink ejection amount to the identical position. In particular, for example, during printing in the conventional YMC mode, the ink ejection amount ejected to the identical position for a short time, during which a single time of the main scanning operation (1 pass) is carried out, is at most 300% (Y+M+C) when the positions in the sub-scanning direction of the nozzle array in each of the inkjet heads are the same as illustrated in FIG. 5B. During printing in four-color separation mode in which the inkjet head for K color is further used in YMC mode, the ink ejection amount to the identical position is at most 400% (Y+M+C+K) when printing is carried out without performing, for example, under color removal.

Then, when the ink ejection amount to the identical position increases and exceeds, for example, 120-150%, bleeding is apt to occur before the inks are fixed to the medium by drying of the inks, or the like. Consequently, the image quality of an image printed seems to degrade. Additionally, when using, for example, a paper medium, curling and cockling are apt to occur due to influence of a solvent (water or the like) in the inks. When using, for example, a non-absorbable medium or the like, bleeding of the inks occurs remarkably.

Here, because the configuration of the head 12 is a compact configuration in which the inkjet heads 102*y* to 102*k* are aligned as illustrated in FIG. 5B, this configuration is suitable for the case where the printing apparatus 10 is, for example, downsized. However, it can be said that the foregoing problem is apt to occur when used in, for example, a printing apparatus to perform printing at high speed.

Whereas, in order to decrease the ink amount simultaneously ejected to the identical position, it is also conceivable to dispose the inkjet heads 102*y* to 102*k* side by side in the sub-scanning direction instead of the main scanning direction. In this case, the inkjet heads 102*y* to 102*k* are disposed side by side in the sub-scanning direction so that their respective positions in the sub-scanning direction are shifted from one another.

Figure 5C:
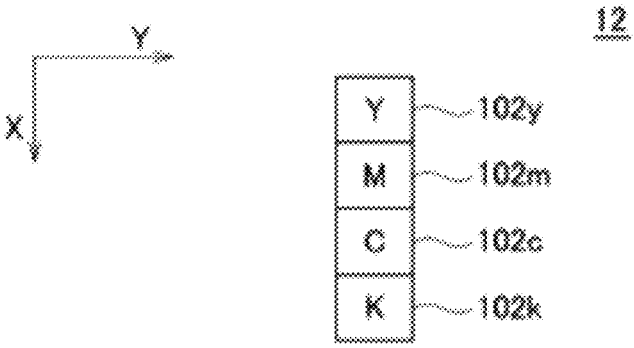

FIG. 5C illustrates an exemplary configuration in which the inkjet heads 102*y* to 102*k* are disposed side by side in the sub-scanning direction. In this configuration, the inkjet heads 102*y* to 102*k* respectively eject an ink droplet to different regions in the medium in the main scanning operation on each time. With this configuration, it is therefore possible to appropriate decrease the ink ejection amount simultaneously ejected to the identical position on the medium. It is also possible to, for example, restrain the occurrence of bleeding of ink. This, however, leads to enlargement of the carriage having the inkjet heads mounted thereon, resulting in enlargement of the printing apparatus 10.

Figure 6A:
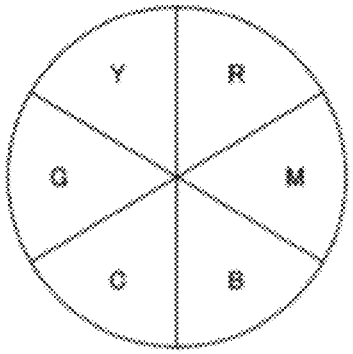
FIGS. 6A to 6E are diagrams describing the configuration of the head 12 when printing in seven-color separation mode.

Whereas, in this embodiment, the ink ejection amount simultaneously ejected to the identical position on the medium is more appropriately decreased by using, for example, the head 12 having the configuration illustrated in FIG. 3. FIGS. 6A to 6E are diagrams describing the configuration of the head 12 when printing in seven-color separation mode. FIG. 6A is a diagram describing a relationship between ink colors used in seven-color separation mode.

As described earlier, in addition to the individual color inks of Y, M, and C that are the three kinds of primary colors for performing color expressions, the individual color inks of R, G, and B that are respectively colors between the above colors are further used when printing in seven-color separation mode. Moreover, a variety of different colors are expressed by mixing these inks at different ratios on the medium. In this case, when the colors of inks used for printing are disposed side by side in a color space, the individual colors of Y, M, and C are disposed side by side by interposing therebetween the color between these colors (each color of R, G, and B).

Then, when a variety of different colors are expressed using the six colors illustrated side by side in FIG. 6A, even though two colors disposed adjacent to each other in the diagram may be mixed together, it is unnecessary to perform a color mixing between colors with one or more colors interposed therebetween. More specifically, for example, this embodiment eliminates the need to perform color mixing (color mixing between Y, M, and C) between ink colors for use in the inkjet heads 102*y* to 102*c* for the individual colors of Y, M, and C. It is also unnecessary to perform color mixing (color mixing between R, G, and B) between ink colors for use in the inkjet heads 102*r* to 102*b* for the individual colors of R, G, and B. Consequently, for example, as described above with reference to FIG. 4 and the like, it is possible to eliminate the possibility that a simultaneous ink ejection amount to the identical position exceeds 100% when printing in seven-color separation mode. This makes it possible to decrease the amount of use of inks for itself.

In this embodiment, the ink amount ejected to an identical position in the main scanning operation on an identical time (a simultaneous ink ejection amount during a simultaneous printing scanning) is decreased by disposing the inkjet heads side by side with a predetermined layout using the above characteristic. More specifically, in this embodiment, a layout of the inkjet heads for the colors used in seven-color separation mode are determined as follows.

As described earlier, in this embodiment, the color image printing is carried out by using, for example, seven color inks of Y, M, C, R, G, B, and K, instead of the individual color inks of Y, M, C, and K. When this characteristic is considered in a more generalized manner, it can be considered as, for example, a configuration designed to use at least six different chromatic color inks. It can be considered as, as a more preferable configuration, a configuration designed to further use K (black) ink in addition to the six chromatic inks.

As to the layout of the inkjet heads to eject an ink droplet of each of these colors, in this embodiment, the carriage 14 (refer to FIG. 1) holds the inkjet heads in the head 12 (refer to FIG. 1) in a state of being divided into a plurality of head arrays as illustrated in, for example, FIG. 3. In this case, the inkjet heads disposed side by side in each of the head arrays are selected so that only the inkjet heads that do not simultaneously eject an ink droplet to an identical position are included in an identical head array. As used herein, simultaneously ejecting an ink droplet to the identical position denotes, for example, ejecting an ink droplet to an identical pixel position in the main scanning operation on an identical time. The phrase that the inkjet heads are included in the head array denotes, for example, the nozzle arrays of the inkjet heads are disposed side by side in the main-scanning direction in the head array. On this occasion, the inkjet heads for colors which may simultaneously eject an ink droplet to an identical position are respectively disposed in different head arrays, so that their respective positions in the sub-scanning direction are shifted by an amount equivalent to or greater than a nozzle array width.

Figure 6B:
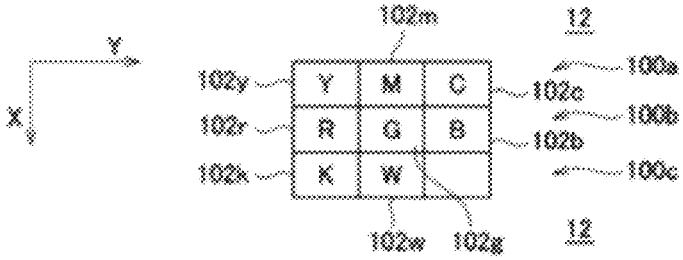
Figure 6C:
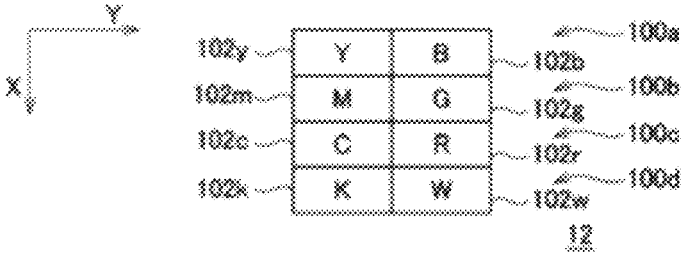
Figure 6D:
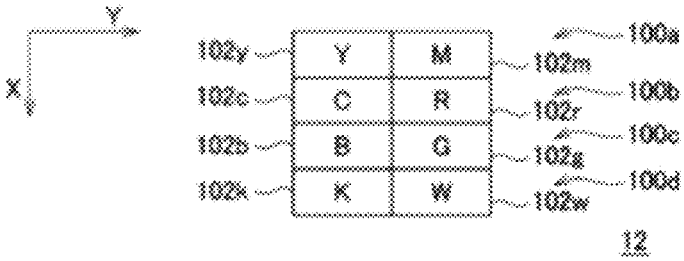

FIGS. 6B to 6D are diagrams illustrating various exemplary configurations of the head 12 in this embodiment, and illustrate specific exemplary layouts (head layouts) that the individual color inkjet heads used in seven-color separation mode are disposed side by side so as to have the foregoing characteristic. FIG. 6B is a diagram illustrating an exemplary head layout in the head 12, and illustrates an exemplary head layout obtainable by adding the inkjet head 102*w* that ejects a W (white) ink droplet to the configuration illustrated in FIG. 3. In this case, the inkjet head 102*w* is disposed in the head array 100*c* together with the inkjet head 102*k*. Thus, the inkjet head 102*w* is disposed while being dislocated in the sub-scanning direction with respect to the inkjet heads 102*y* to 102*c* and 102*r* to 102*g* respectively disposed side by side in the head arrays 100*a* and 100*b*.

In this example, the inkjet head 102*w* is an exemplary inkjet head for a special color. It is also conceivable to use, an inkjet head for a special color other than W color, such as a clear color and a metallic color, in the head 12. In this case, the inkjet head for the special color is preferably disposed while being dislocated in the sub-scanning direction with respect to the inkjet heads 102*y* to 102*c*, and 102*r* to 102*g*, as in the case with the inkjet head 102*w*.

As described above, for example, when a variety of different colors are expressed using the six colors illustrated side by side in FIG. 6A, even though two colors disposed adjacent to each other in the diagram may be mixed together, it is unnecessary to perform color mixing between colors with one or more colors interposed therebetween. Therefore, when used the head 12 having the configuration illustrated in FIG. 6B, the in-jet heads disposed side by side in the head arrays 100*a* and 100*b* are made into such a configuration of ejecting an ink droplet from merely not more than one inkjet head in each of the head arrays in the main scanning operation on each time with respect to each pixel position set on the medium. As used herein, ejecting an ink droplet from merely not more than one inkjet head to each pixel position denotes, for example, ejecting an ink droplet from one inkjet head to the pixel position selected as a pixel to which the ink droplet is ejected.

With this configuration, it is possible to, for example, appropriately prevent the inkjet heads from simultaneously ejecting an ink droplet to an identical pixel position. This makes it possible to, for example, more appropriately reduce the ink ejection amount to each position on the medium.

On this occasion, the individual colors including K (black) color can be more appropriately expressed by further using the inkjet head 102*k* in addition to the inkjet heads 102*y* to 102*c*, and 102*r* to 102*g*. On this occasion, the K color ink may be ejected to the identical position on the medium with respect to each of the color inks. In this regard, with this configuration, the inkjet head 102*k* is held while being dislocated in the sub-scanning direction with respect to each of the inkjet heads 102*y* to 102*c* and 102*r* to 102*g*. Hence, with this configuration, it is possible to appropriately prevent the inkjet head 102*k* from ejecting an ink droplet to the position identical to that in the inkjet heads 102*y* to 102*c* and 102*r* to 102*g* in the main scanning operation on an identical time. This makes it possible to, for example, more appropriately reduce the ink ejection amount to each position on the medium.

In this embodiment, as described above, an ink droplet is ejected from merely not more than one inkjet head in each of the head arrays in the main scanning operation on each time with respect to each pixel position set on the medium. However, when the characteristic of this embodiment is considered in a more generalized manner, this can also be considered as a configuration designed to eject an ink droplet from merely not more than two inkjet heads in each of the head arrays in the main scanning operation on each time with respect to each pixel position set on the medium. In this case, it is conceivable to eject an ink droplet to an identical position from two inkjet heads in an identical head array in order to make fine color adjustment or the like. Even in this case, the ink ejection amount to each position on the medium is appropriately reducible than the case of printing in, for example, YMC mode or four-color separation mode.

The specific configuration of the head 12 is not limited to the configuration described above, but another configuration is conceivable. FIGS. 6C and 6D illustrate other exemplary head layouts in the head 12.

In the configurations illustrated in FIGS. 6C and 6D, the inkjet heads in the head 12 are dividedly disposed side by side in four head arrays 100*a* to 100*d*. Of these inkjet heads, the inkjet heads 102*y* to 102*k* and 102*r* to 102*g* are dividedly disposed side by side in three head arrays 100*a* to 100*c*. Even in this case, the head arrays 100*a* and 100*b* are exemplary first and second arrays. The head array 100*c* is an exemplary third array in which the inkjet heads are disposed side by side in the main scanning direction while being dislocated in the sub-scanning direction with respect to the inkjet heads in the first array and the inkjet heads in the second array.

In this case, in at least one of the head arrays 100*a* to 100*c*, one of the inkjet heads 102*y* to 102*c* for the individual colors of Y, M, and C, and one of the inkjet heads 102*r* to 102*g* for the individual colors of R, G, and B are disposed side by side in the main scanning direction. More specifically, in the case illustrated in FIG. 6C, one of the inkjet heads 102*y* to 102*c* for the individual colors of Y, M, and C, and one of the inkjet heads 102*r* to 102*g* for the individual colors of R, G, and B are disposed side by side in each of the head arrays 100*a* to 100*c*. In the case illustrated in FIG. 6D, one of the inkjet heads 102*y* to 102*c* for the individual colors of Y, M, and C (the inkjet head 102*c*), and one of the inkjet heads 102*r* to 102*g* for the individual colors of R, G, and B (the inkjet head 102*r*) are disposed side by side in the head array 100*b*.

Even in these cases, the inkjet head for a color that needs not to be mixed for expressing a variety of different colors is selected as the inkjet heads disposed side by side in an identical head array. Therefore, when one of the inkjet heads 102*y* to 102*c* and one of the inkjet heads 102*r* to 102*b* are disposed side by side in the identical head array, the color of an ink droplet ejected from the inkjet heads 102*r* to 102*b* is a color between two colors of the Y, M, and C colors that are the three kinds of primary colors, except for the color of an ink droplet ejected from the inkjet heads 102*y* to 102*c* in the identical head array.

More specifically, for example, in the case illustrated in FIG. 6C, the inkjet head 102*y* and the inkjet head 102*b* are disposed side by side in the head array 100*a*. B color that is the color of ink ejected from the inkjet head 102*b* corresponds to a color between M color and C color other than Y color in Y, M, and C colors. In the head array 100*b* in which the inkjet head 102*m* and the inkjet head 102*g* are disposed side by side, G color that is the color of ink ejected from the inkjet head 102*g* corresponds to a color between Y color and C color other than M color in Y, M, and C colors. In the head array 100*c* in which the inkjet head 102*e* and the inkjet head 102*r* are disposed side by side, R color that is the color of ink ejected from the inkjet head 102*r* corresponds to a color between Y color and M color other than C color in Y, M, and C colors.

In the case illustrated in FIG. 6D, in the head array 100*b* in which the inkjet head 102*c* and the inkjet head 102*r* are disposed side by side, R color that is the color of ink ejected from the inkjet head 102*r* corresponds to a color between Y color and M color other than C color in Y, M, and C colors. Hence, in these cases also, the ink ejection amount simultaneously ejected to each position on the medium is appropriately reducible.

In the cases illustrated in FIGS. 6C and 6D, the inkjet head 102*k* and the inkjet head 102*w* are disposed in the head array 100*d*. This makes it possible to appropriately perform printing using black color and white color in a manner identical or similar to, for example, that in the case illustrated in FIG. 6B.

In association with FIG. 5C and the like, the foregoing has described that the carriage is enlarged and the printing apparatus is also enlarged relating to the configuration designed to dispose the inkjet heads 102*y* to 102*k* in the sub-scanning direction. Therefore, the configurations illustrated in FIGS. 6B to 6D also seem at first sight to cause the problem of enlargement of the carriage and the printing apparatus. However, when considered as the configuration intended to perform printing in, for example, seven-color separation mode, the configurations illustrated in FIGS. 6B to 6D can also be rather considered as a configuration capable of achieving a more compact carriage and the like.

Figure 6E:
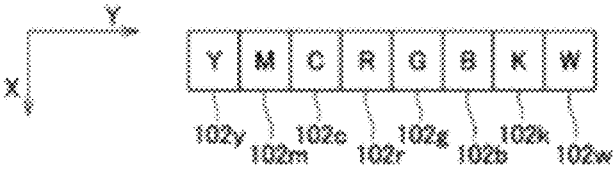

FIG. 6E is a diagram illustrating an exemplary layout of inkjet heads used in seven-color separation mode, and illustrates an exemplary configuration of the head 12 when the inkjet heats 102*y* to 102*c*, 102*r* to 102*g*, and 102*k* are merely disposed side by side in the main scanning direction. As apparent from the diagram, it can be considered that a length in the main scanning direction in the head 12 extremely increases in this configuration. Consequently, it can be considered that the printing apparatus also needs to have an extremely large width in the main scanning direction.

In contrast, the configurations illustrated in FIGS. 6B to 6D can be considered to be configurations designed to dispose the inkjet heads side by side in a more compact form in the case of using a large number of inkjet heads as in seven-color separation mode. Hence, it can also be said that this embodiment is capable of, for example, appropriately downsizing the configuration of the head 12.

Figure 7:
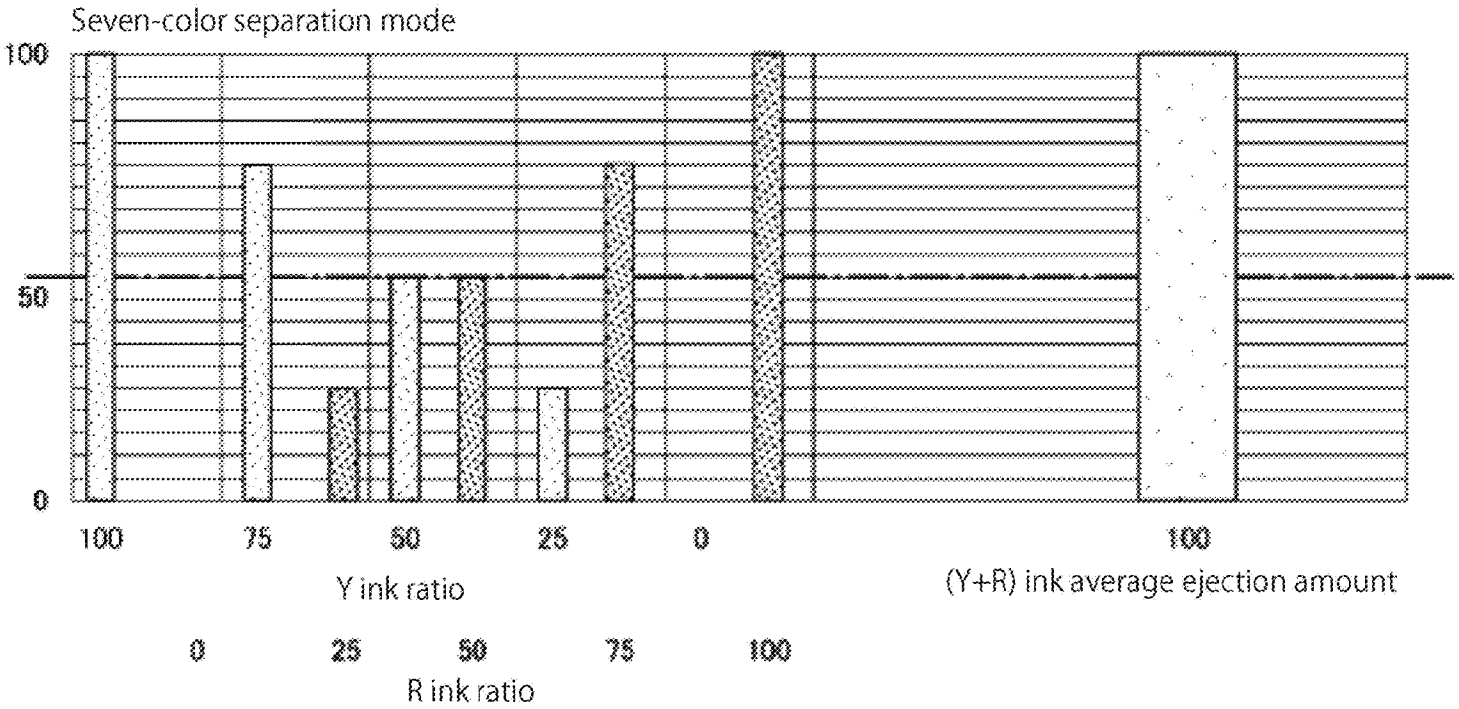
FIG. 7 is a diagram describing an ink ejection amount when printing in seven-color separation mode.

The point that this embodiment is capable of reducing the ink ejection amount to each position on the medium is described in more detail below. FIG. 7 is a diagram describing the ink ejection amount when printing in seven-color separation mode. FIG. 7 illustrates exemplary changes in the ink ejection amount of Y color and R color when making a color mixing (color expression) with Y color and R color under the conditions that a total (Y+R) of Y color ink and R color ink is kept constant at 100%. The ink ejection amount illustrated in FIG. 7 is obtained in the following manner. The ink ejection amount when printing in seven-color separation mode is calculated by assuming the case of using the head 12 having the configuration illustrated in, for example, FIG. 6E, instead of the head 12 having the configuration of this embodiment as illustrated in, for example, FIGS. 6B to 6D.

As illustrated in the diagram, a maximum value of an ink ejection amount simultaneously ejected to an identical position is reducible to 100% by carrying out printing in seven-color separation mode. However, an average ink ejection amount may be preferably further decreased depending on printing conditions or the like. More specifically, the average ink ejection amount is preferably further decreased in order to more appropriately restrain the occurrence of bleeding when using, for example, a medium susceptible to bleeding of ink. It is preferable to further decrease the ink average ejection amount in order to also more appropriately restrain curling, cockling, or the like. It is also preferable to further decrease the ink average ejection amount, for example, when both side printing is carried out using a fabric medium.

In this regard, this embodiment is adapted to dispose the plurality of inkjet heads in the plurality of head arrays, instead of merely using seven-color separation mode. This embodiment also employs the configuration that only a plurality of inkjet heads for colors designed not to simultaneously eject an ink droplet to an identical position are included in an identical head array.

Figure 8A:
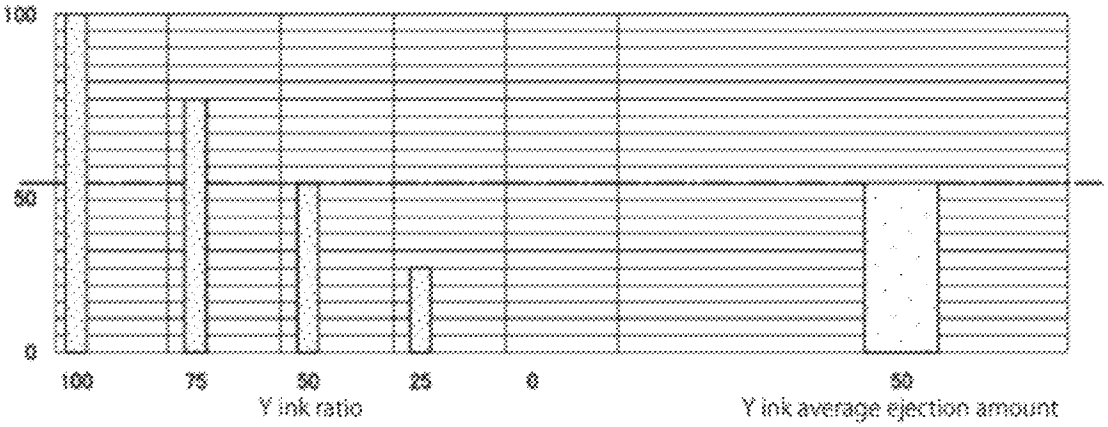
FIGS. 8A and 8B are diagrams describing effect of dislocating in the sub-scanning direction in the inkjet heads that simultaneously eject an ink droplet to an identical position.
Figure 8B:
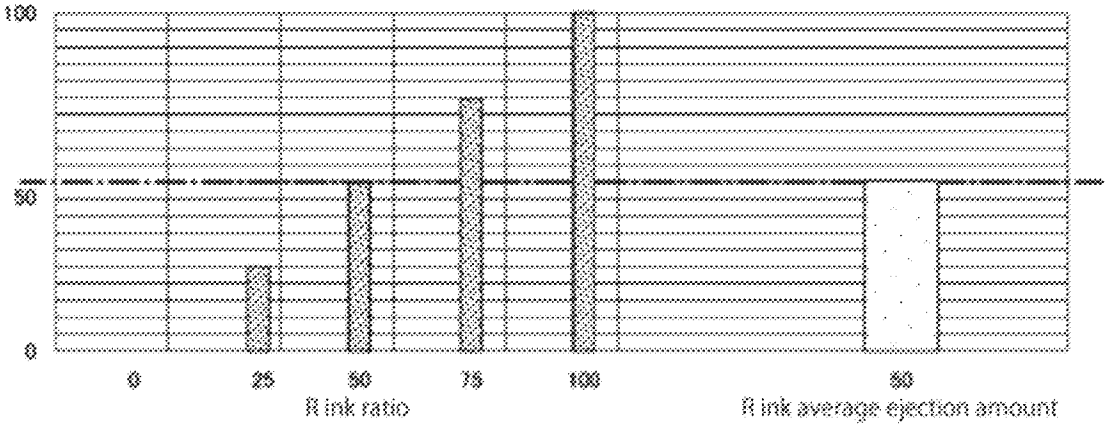

FIGS. 8A and 8B are diagrams describing effect of shifting positions in the sub-scanning direction in the inkjet heads that simultaneously eject an ink droplet to an identical position. FIGS. 8A and 8B illustrates exemplary changes in the ink ejection amount of Y color and R color when making a color mixing with Y color and R color under the conditions that a total (Y+M) of Y color ink and M color ink is kept constant at 100%, when the inkjet head 102*y* for Y color and the inkjet head 102*r* for R color are disposed in another head array while being dislocated in the sub-scanning direction.

FIGS. 8A and 8B more specifically illustrates, as an exemplary change of ink ejection amount, a combination of an ink ejection amount of Y color and an ink ejection amount of R color, and the ink ejection amount. FIGS. 8A and 8B illustrates, in terms of ink ejection amount, the ink ejection amount of Y color and the ink ejection amount of R color, provided that appearance probability is equal irrespective of a combination of inks.

The diagram shows that, with this embodiment, for example, the average ink ejection amount is 50% and is reducible to a half of 100% in the case illustrated in FIG. 7. This shows that the ink ejection amount simultaneously ejected to an identical position is more appropriately reducible than the case of merely using seven-color separation mode.

Figure 9:
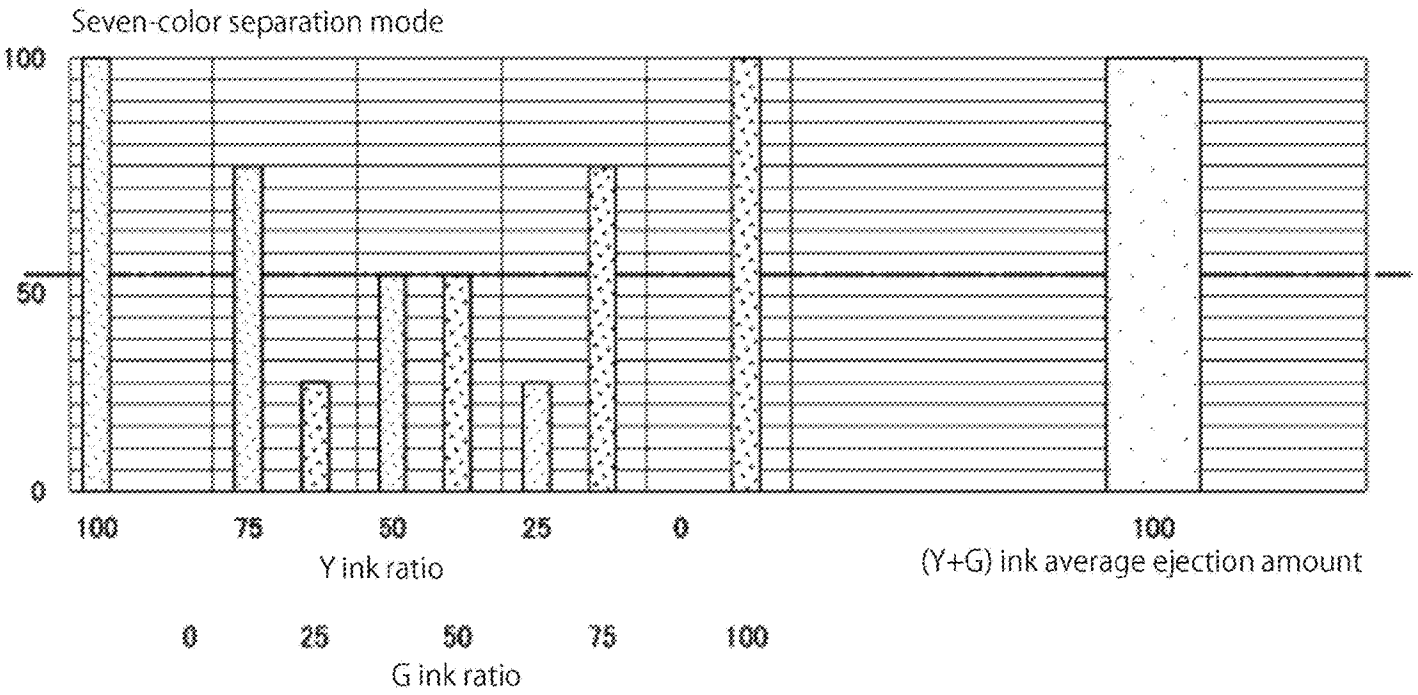
FIG. 9 is a diagram describing a matter similar to that in FIG. 7 in terms of another color.
Figure 10A:
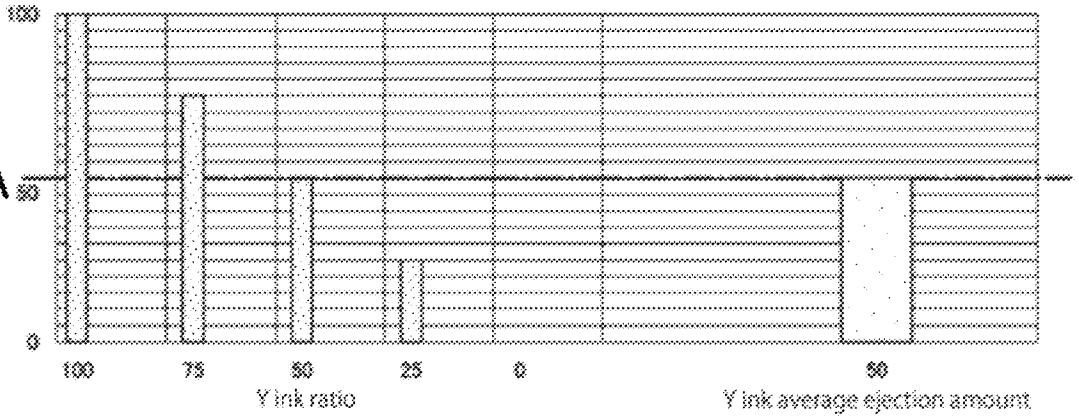
FIGS. 10A and 10B are diagrams describing a matter similar to that in FIGS. 8A and 8B in terms of another color.
Figure 10B:
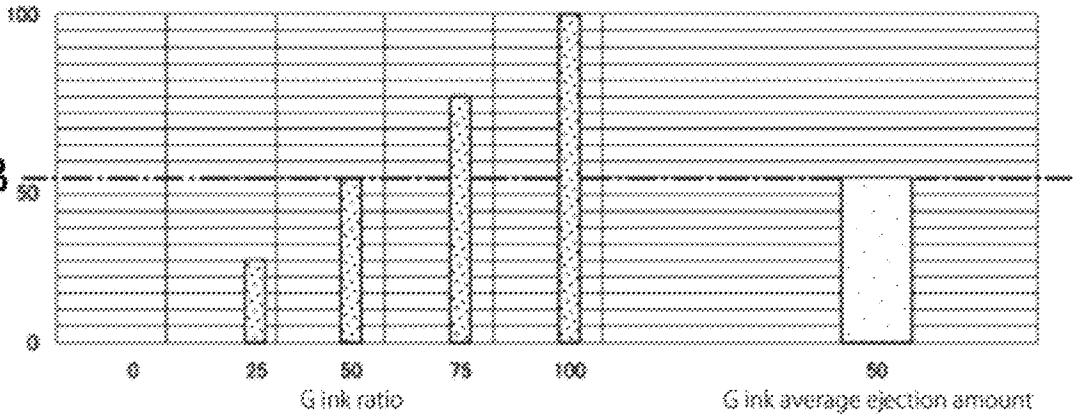

FIGS. 9 and 10A-10B are diagrams respectively describing a matter similar to that in FIG. 7 and that in FIGS. 8A and 8B in terms of another color. FIG. 9 is the diagram describing the matter similar to that in FIG. 7 in terms of another color. FIG. 9 illustrates an example of changes in the ink ejection amount of Y color and G color when making a color mixing with Y color and G color under the conditions that a total (Y+G) of Y color ink and G color ink is kept constant at 100%. FIGS. 10A and 10B is a diagrams describing the matter similar to that in FIGS. 8A and 8B in terms of another color. FIGS. 10A and 10B illustrates exemplary changes in the ink ejection amount of Y color and G color when making a color mixing with Y color and G color under the conditions that a total (Y+G) of Y color ink and G color ink is kept constant at 100%, when the inkjet head 102*y* for Y color and the inkjet head 102*g* for G color are disposed in another head array while being dislocated in the sub-scanning direction.

FIGS. 9 and 10 illustrate that the ink ejection amount simultaneously ejected to an identical position is reducible to 50%, whereas 100% in the case of merely using seven-color separation mode, in terms of Y color and G color as in the case of Y color and R color respectively illustrated in FIGS. 7 and 8. Although illustration and detail description are omitted here, this embodiment is capable of obtaining a similar effect in a combination of other colors.

Thus, with this embodiment, the ink amount simultaneously repetitively ejected to an identical position is appropriately reducible by, for example, disposing the inkjet heads, which can simultaneously eject an ink droplet to the identical position, so as to be a predetermined distance or more away from each other in the sub-scanning direction while using the advantage of seven-color separation mode. More specifically, with this embodiment, the ink ejection amount simultaneously ejected to an identical position is appropriately reducible so as to be at most 100% or less and, on average, appropriately 50%.

This makes it possible to appropriately prevent, for example, the problem of the occurrence of bleeding when printing on a paper or fabric medium. It is also possible to appropriately prevent the occurrence of curling and cockling due to absorption of a large amount of ink.

This case also makes it possible to perform the following in addition to the reduction of the ink ejection amount simultaneously ejected to an identical position. That is, by disposing the inkjet heads in the head arrays while being dislocated in the sub-scanning direction, it is possible to dry ink by using moving time during which the inkjet heads of each head array are moved relative to the medium. This makes it possible to more appropriately prevent bleeding due to mixing of different color inks.

In this case, because the ink can appropriately be dried before the occurrence of bleeding of the inks, more appropriate printing is performable even in a printing apparatus that performs high-speed printing (high speed machine). More appropriate printing is performable even when using, for example, a non-absorbable medium having properties that hardly absorb ink. More specifically, more appropriate printing is performable even when using the non-absorbable medium, such as plastic, metal, and glass. On this occasion, a variety of different inks are usable according to properties of a medium. More specifically, it is conceivable to use a variety of different inks, such as latex inks, UV inks, solvent UV inks, or aqueous UV inks, by being combined with a variety of different media.

Furthermore, this embodiment is capable of achieving high color reproducibility by carrying out printing in seven-color separation mode. More specifically, high color reproducibility approximately equal to or more than that of offset printing machines or the like is also achievable by carrying out printing in seven-color separation mode. This makes it possible to perform high-speed printing with high color reproducibility.

In this embodiment, even when carrying out both printing, an average of a total ink amount for both sides is reducible to approximately 100%. Therefore, with this embodiment, a total ink amount for both sides with respect to individual positions is appropriately reducible when carrying out both printing.

Additionally, with this embodiment, printing with high color reproducibility is appropriately performable at high speed with respect to, for example, both sides of the medium by combining the various characteristics described above. Consequently, for example, printing for a use carried out by a conventional offset printing machine is also appropriately performable by the inkjet printer.

The following is a supplement to the description of the configuration of this embodiment. Firstly, the reason why high definition printing is performable by carrying out printing in seven-color separation mode is described in more detail.

Figure 11A:
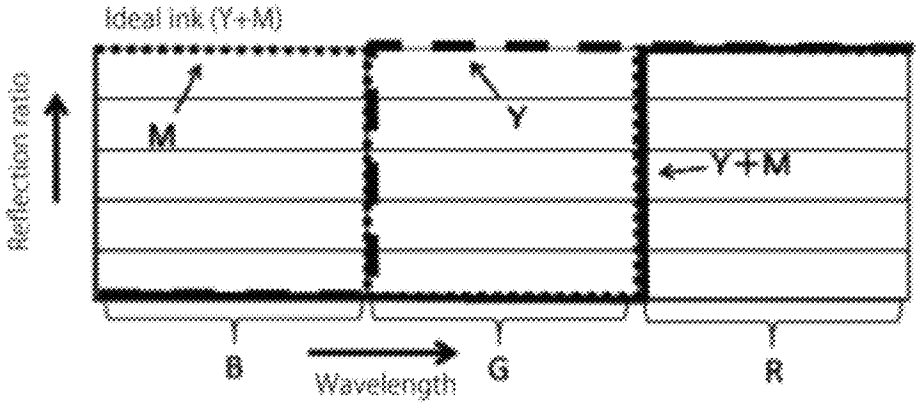
FIGS. 11A and 11B are diagrams describing color reproducibility when printing in four-color separation mode.
Figure 11B:
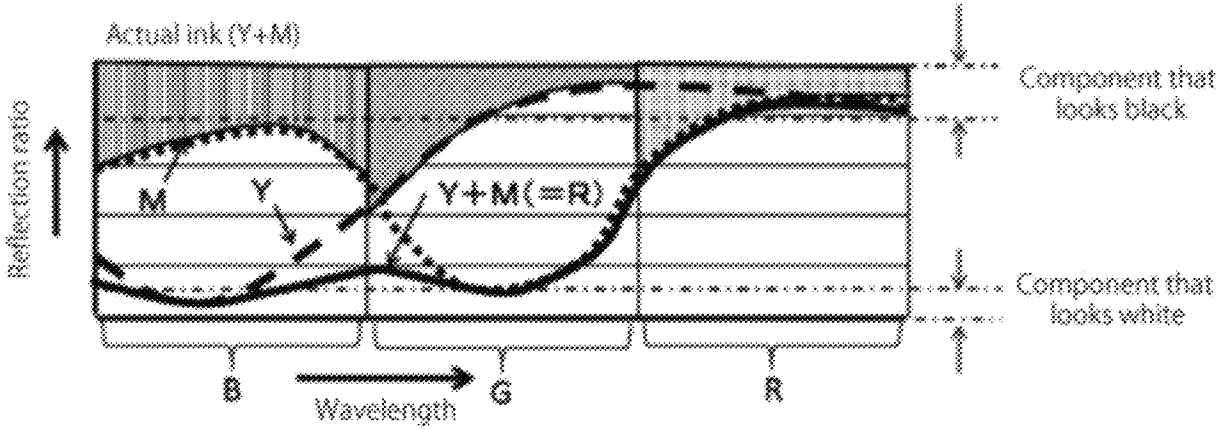

FIGS. 11A and 11B are diagrams describing color reproducibility when printing in four-color separation mode, and illustrates exemplary color reproducibility when a well-known pigment ink is used as four color inks of Y, M, C, and K. FIG. 11A is a diagram describing color reproducibility when using an ideal ink different from an actual ink, and illustrates an exemplary relationship between a reflectance of each color ink and a wavelength when R color is expressed using Y color ink and M color ink.

As illustrated in the diagram, each of M color and Y color inks has the characteristic that each one indicates a predetermined reflectance in a fixed range of wavelength range, and reflects no light in the rest of the wavelength range. In this case, R color that is a color of M color and Y color can be expressed by making a color mixing of M color and Y color as indicated as "Y+M" in the diagram. When modeling is carried out on an ideal ink, the color mixing of Y color and M color results in a state in which components in the wavelength range corresponding to G color and B color are absorbed, and only components of a wavelength corresponding to R color are observed as reflected light. Therefore, with the use of this ideal ink makes it possible to appropriately reproduce, for example, an intermediate color of colors of inks, thereby performing high definition printing.

However, when using an actual ink, it is difficult to perform the high definition printing due to a characteristic difference from the ideal ink. FIG. 11B illustrates exemplary color reproducibility when using the actual ink, and illustrates an exemplary relationship between a reflectance of each color ink and a wavelength when R color is expressed using Y color ink and M color ink.

When using the actual ink, a pigment or the like that are color materials contained in the ink have characteristic different from that of the ideal ink in terms of reflectance and absorption characteristics, for example, as illustrated in FIG. 11B. As a result, as illustrated as a component that looks black, and a component that looks white in the diagram, bleeding may occur in a reproduced color of R color obtainable by mixing Y color and M color. A similar problem may occur in a reproduced color of G color and B color when using four-color separation mode.

In contrast, when printing in seven color separation, because the individual colors of R, G, and B can be directly expressed without making a color mixing of a plurality of colors, the occurrence of the above problem is appropriately restrainable. This leads to appropriate high definition in terms of color reproducibility when compared with four-color separation mode.

When an intermediate color, such as R color, is expressed in four-color separation mode, dots of a plurality of color inks subjected to color mixing are overlappingly formed at an identical position. In this case, by using, for example, the head 12 of the conventional configuration described using FIG. 2A, a color overlapping manner is reversed depending on a direction of the main scanning direction. Therefore, when performing reciprocating main scanning operation (bidirectional main scanning operation), the order to ink colors that reach the medium is reversed between a forward pass and a backward pass, thus causing a difference in reproduced color. In order to restrain the occurrence of this problem, t is necessary to avoid a difference in ink overlapping manner between the forward pass and the backward pass by additionally disposing the inkjet heads for some colors, such as M color and C color, and arranging so that the inkjet heads for the individual colors are disposed side by side in the order of, such as C, M, Y, M, C, and K. However, because there exist the inkjet heads used only one of the forward and backward passes, this case results in a so-called state in which the additional inkjet heads of low use efficiency are added. Consequently, the use efficiency of the inkjet heads is lowered considerably.

In contrast, when printing in seven-color separation mode, the individual colors of R, G, and B can be expressed without mixing a plurality of colors, and hence, no difference occurs in reproduced color in terms of individual colors of R, G, and B between the forward pass and the backward pass in the bidirectional main scanning operation. As described earlier, the head 12 used in this embodiment is designed so that the inkjet heads do not eject an ink droplet to an identical position in the main scanning operation on an identical time, for example, as illustrated in FIG. 3. On this occasion, in the main scanning operation on each time (during 1 pass), only one color ink of the primary colors (Y, M, and C) and only one color ink of the secondary colors (R, G, and B) land at an identical position. Therefore, owing to this, no difference occurs in the order of color landings between the forward pass and the backward pass when performing the bidirectional main scanning operation. Accordingly, the color overlapping manner is not reversed between the forward pass and the backward pass. Therefore, owing to this, no difference occurs in reproduced color between the forward pass and the backward pass in the bidirectional main scanning operation. This makes it possible to appropriately obtain high definition image quality similar to that in the case of performing only one-directional main scanning operation even when speeding it up to double-speed compared to the case of performing only one-directional main scanning operation, by performing the bidirectional main scanning operation.

The following is a supplement to the description of exemplary modifications and exemplary applications of the configuration of this embodiment. The foregoing has mainly described the case of using the individual colors of Y, M, and C and the individual colors of R, G, and B as color inks for expressing a variety of different colors. However, the color of ink used as a color ink is not limited to this combination, and there are various possible changes. In this case, it is preferable to use six or more different color inks. More specifically, for example, colors (colors between Y, M, and C) used in combination with the individual colors of Y, M, and C are not limited to the individual colors of R, G, and B, and it is conceivable to use other colors. On this occasion, it is conceivable to use, for example, an orange color ink instead of R color ink.

Special color inks other than the color inks, such as Y, M, C, and R, G, and B, are not limited to the colors described above, and it is conceivable to use different color inks. More specifically, special color inks, such as pearl color, fluorescent colors, gray color, and orange color, may be used besides W color, clear color, metallic color, and the like. Inkjet heads for the special colors are preferably disposed in a head array other than the inkjet heads 102*y* to 102*c*, and 102*r* to 102*g* as described with reference to FIGS. 6A to 6E and the like.

A layout of the inkjet head for the special color may be determined according to whether it ejects to an identical position at the same time as the inkjet heads 102*y* to 102*c* and 102*r* to 102*g*. For example, when the inkjet head for the special color never ejects an ink droplet to the same position as in one of the inkjet heads 102*y* to 102*c* and 102*r* to 102*g*, the inkjet head for the special color may be disposed in the same head array as the one of the inkjet heads 102*y* to 102*c* and 102*r* to 102*g*.

The number of the head arrays in the head 12 is not limited to a specific number as long as it is two or more. There are various possible modifications of the specific configuration of the head 12.

Figure 12A:
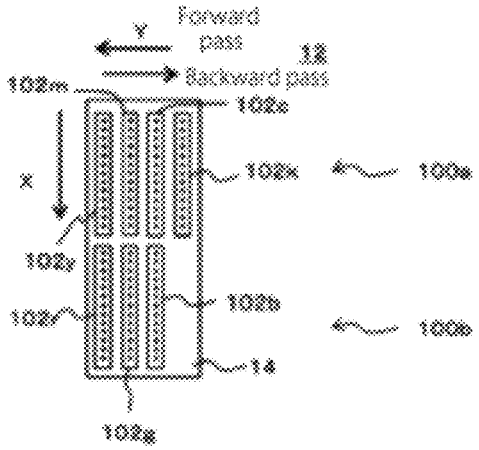
FIGS. 12A and 12B are diagrams describing another modification of the configuration of the head 12.
Figure 12B:
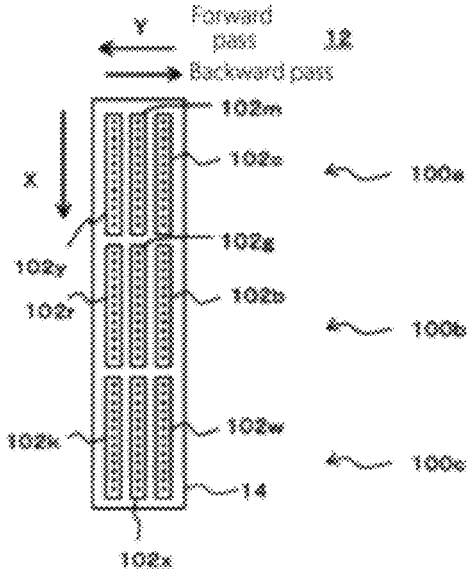

FIGS. 12A and 12B are diagrams describing further exemplary modifications of the configuration of the head 12. FIG. 12A illustrates the further modification of the configuration of the head 12. The configurations in FIGS. 12A and 12B which are identified by the same reference numerals as FIGS. 1 to 11B may have the characteristics identical or similar to the configurations in FIGS. 1 to 11B.

As described earlier, the printing in seven-color separation mode is capable of achieving higher color reproducibility than, for example, the printing in four-color separation mode. However, a difference in color may occur as compared to an image printed in four-color separation mode with the conventional configuration, depending on a layout of the inkjet heads in head 12 designed to perform printing in seven-color separation mode. In this case, a difference in reproduced color may occur between an image printed in seven-color separation mode by the printing apparatus 10, and an image that is already printed in four-color separation mode.

In this regard, high compatibility with, for example, a printing apparatus that is already in place and performs printing in four-color separation mode may be needed depending on a use of the printing apparatus 10. Therefore, the configuration of the head 12 that performs printing in seven-color separation mode may be preferably a configuration taking into consideration the compatibility with the configuration for printing in four-color separation mode.

In this regard, in the configuration illustrated in FIG. 12A, the inkjet heads y to k and r to b are disposed so as to include the configuration for printing in four-color separation mode. More specifically, the inkjet heads y to k and r to b are dividedly disposed in the head arrays 100*a* and 100*b* in the head 12. Of these inkjet heads, the inkjet heads y to k for the same color as the inkjet head used for printing in four-color separation mode are disposed side by side in the main scanning direction in the head array 100*a* while being aligned in the sub-scanning direction. The inkjet heads r to b used only during printing in seven-color separation mode are disposed side by side in the main scanning direction in another head array 100*b* while being aligned in the sub-scanning direction.

Even with this configuration, the inkjet heads for the individual colors of Y, M, and C and the inkjet heads for the individual colors of R, G, and B can be appropriately disposed so that their respective positions in the sub-scanning direction do not overlap one another, in the carriage that moves at an identical speed during the main scanning operation. Thus, the occurrence of bleeding can appropriately be restrained by reducing the ink ejection amount simultaneously ejected to an identical position. It is also possible to appropriately prevent, for example, that the color overlapping manner is reversed between the forward pass and the backward pass in the bidirectional main scanning operation. This makes it possible to appropriately achieve high color reproducibility even when high-speed printing is carried out by performing the bidirectional main scanning operation. Therefore, even with this configuration, it is possible to appropriately print, for example, a high-definition high-quality image at high speed.

When focusing here only on the inkjet heads 102*y* to 102*k* disposed side by side in the head array 100*a*, the layout of these inkjet heads is identical to that in the configuration of the conventional head illustrated in FIG. 2A. Therefore, even when using the head 12 having the configuration illustrated in FIG. 12A, printing under the same conditions as the conventional four-color separation mode becomes possible by carrying out printing using only the inkjet heads 102 to 102*k* disposed side by side in the head array 100*a*. This makes it possible to appropriately achieve the same color producibility as the image that is already printed in four-color separation mode. Hence, when using the head 12 having the configuration illustrated in FIG. 12A, for example, it is possible to appropriately perform, as needed, printing under the same conditions as the printing apparatus that is already in place and performs printing in four-color separation mode. This makes it possible to appropriately obtain high compatibility with the printing apparatus that is already in place.

When using the configuration taking into consideration the compatibility with the conventional printing apparatus for four-color separation mode as in the head 12 having the configuration illustrated in FIG. 12A, it is preferable to make it possible to perform printing in the printing apparatus 10 by switching between four-color separation mode and seven-color separation mode. In this case, it is conceivable to prepare a printing mode for printing in four-color separation mode and a printing mode for printing in seven-color separation mode so as to be switched according to user's instructions. As used herein, the printing mode for printing in four-color separation mode is a printing mode for printing using only the individual colors of Y, M, C, and K that are the same colors as in the case of, for example, printing in four-color separation mode, and the printing mode for obtaining compatibility with the conventional printing apparatus for four-color separation mode.

By making it possible to set the printing modes, a printing operation is performable, as needed, under conditions common to the conventional configuration in the printing apparatus 10 capable of printing in seven-color separation mode. Thus, for example when using either of the printing apparatus having the conventional configuration and the printing apparatus 10 having a novel configuration, the printing operation is performable under the common conditions, thus leading to high compatibility. On this occasion, the printing mode for performing seven-color separation mode is, for example, a printing mode for performing high definition printing. Therefore, with this configuration, it is possible to, for example, appropriately carry out high quality printing as needed. Furthermore, the high compatibility with the conventional configuration is obtainable while maintaining high-definition and high-speed printing performance in, for example, seven-color separation mode.

When making it possible to set the above printing modes, the printing mode for printing in seven-color separation mode is an exemplary first printing mode for performing printing using both of the inkjet heads which are respectively disposed side by side in the head array 100*a* and the head array 100*b*. The printing mode for printing in four-color separation mode is an exemplary second printing mode for performing printing using the inkjet heads disposed side by side in the head array 100*a*, without using the inkjet heads disposed side by side in the head array 100*b*. In this case, the head array 100*a* and the head array 100*b* are exemplary first and second groups, each having the inkjet heads disposed side by side in the main scanning direction.

Further, when making it possible to set the above printing modes, it is conceivable to switch, for example, a separation mode used under control of software according to setting of the printing mode made by a user. Alternatively, a printing mode switching function may be added to the body of the printing apparatus 10. It is also conceivable to perform printing in a printing mode having both of the characteristic of four-color separation mode and the characteristic of seven-color separation mode by, for example, simultaneously executing the printing operation in four-color separation mode and the printing operation in seven-color separation mode at a constant ratio according to desired printing quality or the like.

FIG. 12A illustrates a layout of the inkjet head 102*k* for K color of the basic colors used for color expression, which is arranged together with the inkjet heads 102*y* to 102*c* for the individual colors of Y, M, and C in the main scanning direction (on an identical Y axis) as in the case illustrated in FIG. 2A. However, when considered the compatibility with the conventional printing apparatus for four-color separation mode, sufficient compatibility seems to be obtainable even when the inkjet head 102 for K color is dislocated in the sub-scanning direction with respect to the inkjet heads 102*y* to 102*c*. It is therefore also conceivable to change the position of the inkjet head 102*k* to a position different from that in FIG. 12A.

FIG. 12B is a diagram illustrating a further modification of the configuration of the head 12, and illustrates an exemplary configuration in which the position of the inkjet head 102*k* is different from that in FIG. 12A, and an inkjet head for another color is further added. The configuration illustrated in FIG. 12B can be considered as a configuration obtainable by further adding the inkjet head for another color to the configuration of head 12 illustrated in FIG. 3.

More specifically, in the configuration illustrated in FIG. 12B, the head 12 has a configuration obtainable by adding the inkjet head 102*x* and the inkjet head 102*w*, which are the inkjet heads for special color, to the configuration of the head 12 illustrated in FIG. 3. In this case, the inkjet head 102*x* is the inkjet head for any special color. The inkjet head 102*w* is the inkjet head for white color.

Similarly to the configuration illustrated in FIG. 3, the inkjet heads in the head 12 are dividedly disposed in the head arrays 100*a* to 100*c*. In this case, the inkjet heads y to c are disposed side by side in the main scanning direction in the head array 100*a* while being aligned in the sub-scanning direction. The inkjet heads r to b are disposed side by side in the main scanning direction in the head array 100*b* that is another one, while being aligned in the sub-scanning direction. The inkjet heads 102*k*, 102*x*, and 102*w*, which are other inkjet heads, are disposed side by side in the main scanning direction in the head array 100*c* that is still another one, while being aligned in the sub-scanning direction. Thus, the inkjet head 102*k* is disposed while being dislocated in the sub-scanning direction with respect to the inkjet heads for the individual colors of Y, M, and C and the individual colors of R, G, and B.

Even with this configuration, by disposing the inkjet heads 102*y* to 102*k* and 102*r* to 102*b* in the same manner as in the configuration illustrated in FIG. 3, high-definition printing can be appropriately carried out at high speed by appropriately restraining the occurrence of bleeding. In this case also, the difference in color reproducibility from the conventional printing apparatus for four-color separation mode can be appropriately restrained by making the layout of the inkjet heads y to c for the chromatic colors used in four-color separation mode the same as the layout in the conventional printing apparatus for four-color separation mode.

Therefore, in this case also, it is possible to appropriately obtain high compatibility with the conventional printing apparatus for four-color separation mode. Accordingly, for example, when the use of only the four colors of Y, M, C, and K is sufficient for desired printing quality or the like, printing having high compatibility with the conventional configuration is appropriately performable by using only the inkjet heads 102*y* to 102*k*. In this case also, by preparing the printing mode for printing in four-color separation mode and the printing mode for printing in seven-color separation mode so as to be switched according to user's instructions, the high compatibility with the conventional configuration is obtainable while maintaining high-definition and high-speed printing performance in seven-color separation mode. In the configuration illustrated in FIG. 12B, for example, a variety of different colors can be appropriately expressed to appropriately express more variety of colors by using the inkjet head 102*x* and the inkjet head 102*w*.

As described above, the layout of the inkjet heads 102*y* to 102*r* and 102*r* to 102*b* in the configuration illustrated in FIG. 12B is identical to that in the configuration illustrated in FIG. 3. Therefore, the compatibility with the conventional configuration is also similarly obtainable in the configuration illustrated in FIG. 3. In this case also, it is preferable that the printing mode for printing in four-color separation mode and the printing mode for printing in seven-color separation mode are prepared so as to be switched according to user's instructions.

The layout of the inkjet heads in the head 12 is not limited to the above-described configurations, and further modification may be made. In order to achieve the high compatibility with the conventional configuration in this case, for example, as in the case of the configurations illustrated in FIGS. 12A and 12B, at least the inkjet heads for the three colors of Y, M, and C of the colors of Y, M, C, and K used in four-color separation mode are preferably disposed side by side in the main scanning direction in the same manner as in the configuration illustrated in FIG. 2A.

When focusing particularly on the compatibility with the conventional configuration, it is also conceivable to employ, as the configuration of the head 12 that performs printing in seven-color separation mode, a configuration in which the inkjet heads for all colors are aligned in the main scanning direction, as in the configuration illustrated in FIG. 2B. In this case also, the high compatibility with the conventional configuration is obtainable in the printing apparatus capable of printing in seven-color separation mode by preparing the printing mode for printing in four-color separation mode and the printing mode for printing in seven-color separation mode so as to be switched according to user's instructions.

In this case, a region of the head 12 in which the inkjet heads 102*y* to 102*k* of the inkjet heads are disposed side by side can be considered as a first group in which the inkjet heads are disposed side by side in the main scanning direction. A region of the head 12 in which the inkjet heads 102*r* to 102*b* of the inkjet heads are disposed side by side can be considered as a second group in which the inkjet heads that are different from those in the first group are disposed side by side in the main scanning direction.

As described earlier, the occurrence of bleeding or the like is restrained to achieve the high-definition high-speed printing in this embodiment by reducing the ink ejection amount ejected to an identical position in the main scanning operation on each time in the configuration for printing in seven-color separation mode. In order to obtain this effect, it is preferable to use the head 12 having the configuration described with reference to, for example, FIGS. 3, 6, and 12, instead of aligning the inkjet heads for all colors, as described above.

As described earlier, the head 12 includes the inkjet head 102*x* and the inkjet head 102*w* which are the inkjet heads for special color in the configuration illustrated in FIG. 12B. As illustrated in the diagram, the inkjet head 102*x* and the inkjet head 102*w* are disposed while being aligned in the sub-scanning direction with respect to the inkjet head 102*k* in the head array 100*c* in which the inkjet head 102*k* for K color that is the tertiary color. Thus in this configuration, the inkjet head for special color is disposed while being dislocated in the sub-scanning direction, with respect to the inkjet heads 102*y* to 102*c* for the individual colors of Y, M, and C that are the primary colors, and the inkjet heads 102*r* to 102*b* for the individual colors of R, G, and B that are the secondary colors. Assuming here that a straight line in the main scanning direction passing through the positions at which the inkjet heads y to c for the primary colors is a first axis, a straight line in the main scanning direction passing through the positions at which the inkjet heads r to b for the secondary colors is a second axis, and a straight line in the main scanning direction passing through the positions at which the inkjet head k for the tertiary color is a third axis, it can also be considered as a configuration in which the inkjet head for special color is disposed on the third axis.

When considered a further modification of the layout of the inkjet heads for special colors, it is conceivable to dispose the inkjet heads for special color on a fourth axis that is a straight line in the main scanning direction which is different from the first to third axes. Alternatively, the inkjet head for special color may be disposed on the first or second axis depending on frequency of use of the special color, a probability of simultaneous ejection together with other color, or the like.

As described earlier, this embodiment achieves the configuration in which the inkjet heads do not eject an ink droplet to an identical position in the main scanning operation on an identical time, by using the head 12 having the configuration described with reference to, for example, FIGS. 3, 6, and 12. This makes it possible to prevent, for example, the color overlapping manner from being reversed between the forward pass and the backward pass in the bidirectional main scanning operation, thereby achieving high color reproducibility. This effect is obtainable not only in the case of using, for example, an evaporation drying type ink that is fixed to a medium by volatilizing and removing a solvent, but also in the case of using different inks. Accordingly, the inks used are not limited to specific inks as long as they are inks being ejectable from the inkjet heads, and a variety of different inks are usable as described above. More specifically, when using aqueous UV inks, it is conceivable to use, for example, aqueous dye inks, aqueous pigment inks, latex inks, aqueous UV inks, water-soluble UV-curable dye inks. Alternatively, solvent inks, UV inks, and solvent UV inks may be used besides the aqueous inks.

As described above, it can be considered that the printing apparatus 10 of this embodiment (refer to FIG. 1) is applicable for, for example, a use intended to combine an ink susceptible to the occurrence of bleeding and a medium. Conceivable specific uses are, for example, a textile printer that performs printing onto fabrics, and a digital offset printer that performs printing onto media, such as papers. In this case, it is conceivable to use, as a fabric, non-woven fabrics, other various fabrics, and the like. It is conceivable to use, as a medium, non-absorbable (impermeable) media, such as metal, glass, and plastic films. Besides these, the printing apparatus 10 is widely applicable to printing apparatuses that perform printing by inkjet technology for a variety of different uses, such as indoor-outdoor signage printers, tee shirt printers, smartphone case printers, industrial UV printers, and decoration printers.

INDUSTRIAL APPLICABILITY

The present invention is suitably usable for, for example, printing apparatuses.

The invention claimed is:

1. A printing apparatus for printing on a medium by inkjet technology, the printing apparatus comprising:

six or more inkjet heads, configured to eject mutually different color ink droplets by inkjet technology;

a head holder, configured to hold the inkjet heads so as to face the medium;

a main scanning driver, configured to cause the inkjet heads to perform a main scanning operation to eject an ink droplet while moving relative to the medium in a main scanning direction which is preset; and a sub-scanning driver, configured to cause the inkjet head to move relative to the medium in a sub-scanning direction orthogonal to the main scanning direction;

wherein the head holder is configured to dividedly hold the six or more inkjet heads in a plurality of arrays comprising at least a first array in which the inkjet heads are disposed side by side in the main scanning direction, and a second array in which the inkjet heads are disposed side by side in the main scanning direction while being dislocated in the sub-scanning direction with respect to the inkjet heads in the first array, wherein merely not more than two of the inkjet heads in the first array are configured to eject an ink droplet in a single time of the main scanning operation with respect to a position of each pixel set in a region of the medium which is faced to the inkjet heads in the first array, and wherein merely not more than two of the inkjet heads in the second array are configured to eject an ink droplet in a single time of the main scanning operation, with respect to a position of each pixel set in a region of the medium which is faced to the inkjet heads in the second array;

wherein the six or more inkjet heads comprising:

three first basic color heads that are three inkjet heads respectively configured to eject an ink droplet of three kinds of primary colors for performing color expression, and three second basic color heads that are three inkjet heads respectively configured to eject an ink droplet of a color between two colors of the three kinds of primary colors;

wherein the three first basic color heads are respectively configured to eject an ink droplet of individual colors of Yellow color, Magenta color, and Cyan color, and wherein the three second basic color heads are respectively configured to eject an ink droplet of individual colors of Red color, Green color, and Blue color;

wherein the six or more inkjet heads further comprising: a black color head that is an inkjet head configured to eject an ink droplet of black color, and wherein the head holder holds the black color head while being dislocated in the sub-scanning direction with respect to both of the three first basic color heads and the three second basic color heads;

wherein the head holder is configured to hold the three first basic color heads side by side in the first array, and hold the three second basic color heads side by side in the second array.

2. The printing apparatus according to claim 1, wherein merely not more than one of the inkjet heads in the first array is configured to eject an ink droplet in a single time of the main scanning operation with respect to a position of each pixel set in a region facing the inkjet heads in the first array, and wherein merely not more than one of the inkjet heads in the second array is configured to eject an ink droplet in a single time of the main scanning operation with respect to a position of each pixel set in a region facing the inkjet heads in the second array.

3. The printing apparatus according to claim 2, wherein each of the inkjet heads comprising: a nozzle array in which a plurality of nozzles are disposed side by side in the sub-scanning direction, and wherein the inkjet heads in the second array are disposed side by side in the main scanning direction while being dislocated in the sub-scanning direction with respect to the inkjet heads in the first array by a distance not less than a length of the nozzle array of the inkjet head in the first array.

4. The printing apparatus according to claim 1, wherein each of the inkjet heads comprising: a nozzle array in which a plurality of nozzles are disposed side by side in the sub-scanning direction, and wherein the inkjet heads in the second array are disposed side by side in the main scanning direction while being dislocated in the sub-scanning direction with respect to the inkjet heads in the first array by a distance not less than a length of the nozzle array of the inkjet head in the first array.

5. The printing apparatus according to claim 1, wherein the head holder is configured to dividedly hold the six or more inkjet heads in a plurality of arrays comprising at least the first array, the second array, and a third array in which a plurality of the inkjet heads are disposed side by side in the main scanning direction while being dislocated in the sub-scanning direction with respect to the inkjet heads in the first array and the inkjet heads in the second array, wherein one of the first basic color heads and one of the second basic color heads are disposed side by side in the main scanning direction at least in one of the first array, the second array, and the third array, and wherein a color of an ink droplet ejected from the one second basic color head is a color between two colors of the three kinds of primary colors, except for a color of an ink droplet ejected from the one first basic color head.

6. The printing apparatus according to claim 1, wherein the printing apparatus is configured to enable setting, as a printing mode performed in the printing apparatus, a first printing mode for printing using both of a plurality of inkjet heads disposed side by side in the first array and a plurality of inkjet heads disposed side by side in the second array, and a second printing mode for performing printing using a plurality of inkjet heads disposed side by side in the first array without using a plurality of inkjet heads disposed side by side in the second array.

7. A printing method for printing on a medium by inkjet technology of using the printing apparatus according to claim 1, the printing method comprising:

holding six or more inkjet heads configured to eject mutually different color ink droplets by inkjet technology while being faced to the medium;

causing the inkjet heads to perform: a main scanning operation to eject an ink droplet while moving relative to the medium in a main scanning direction which is preset, and an operation to move relative to the medium in a sub-scanning direction orthogonal to the main scanning direction;

dividedly holding the six or more inkjet heads in a plurality of arrays comprising at least a first array in which the inkjet heads are disposed side by side in the main scanning direction, and a second array in which the inkjet heads are disposed side by side in the main scanning direction while being dislocated in the sub-scanning direction with respect to the inkjet heads in the first array;

causing merely not more than two of the inkjet heads in the first array to eject an ink droplet in a single time of the main scanning operation with respect to a position of each pixel set in a region of the medium which is faced to the inkjet heads in the first array; and causing merely not more than two of the inkjet heads in the second array to eject an ink droplet in a single time of the main scanning operation with respect to a position of each pixel set in a region of the medium which is faced to the inkjet heads in the second array;

wherein the ink droplet of black color is ejected from the black color head.

8. A printing apparatus for printing on a medium by inkjet technology, the printing apparatus comprising:

six or more inkjet heads, configured to eject mutually different color ink droplets by inkjet technology;

a head holder, configured to hold the inkjet heads so as to face the medium; and a main scanning driver, configured to cause the inkjet heads to perform a main scanning operation to eject an ink droplet while moving relative to the medium in a main scanning direction which is preset, wherein the head holder is configured to dividedly hold the six or more inkjet heads in a plurality of groups comprising at least a first group and a second group in each of which the inkjet heads are disposed side by side in the main scanning direction, and wherein the printing apparatus is configured to enable setting, as a printing mode performed in the printing apparatus, a first printing mode for printing using both of a plurality of inkjet heads disposed side by side in the first group and a plurality of inkjet heads disposed side by side in the second group, and a second printing mode for performing printing using a plurality of inkjet heads disposed side by side in the first group without using a plurality of inkjet heads disposed side by side in the second group;

wherein the first group comprising: three first basic color heads that are three inkjet heads respectively configured to eject an ink droplet of three kinds of primary colors for performing color expression, and the second group comprising: three second basic color heads that are three inkjet heads respectively configured to eject an ink droplet of a color between two colors of the three kinds of primary colors;

wherein the three first basic color heads are respectively configured to eject an ink droplet of individual colors of Yellow color, Magenta color, and Cyan color, and wherein the three second basic color heads are respectively configured to eject an ink droplet of individual colors of Red color, Green color, and Blue color;

wherein the head holder holds both of the three first basic color heads and the three second basic color heads, while being dislocated in the sub-scanning direction;

wherein the head holder is configured to hold the three first basic color heads side by side in the first array, and hold the three second basic color heads side by side in the second array.

9. A printing method for printing on a medium by inkjet technology of using the printing apparatus according to claim 8, the printing method comprising:

holding six or more inkjet heads configured to eject mutually different color ink droplets by inkjet technology while being faced to the medium;

causing the inkjet heads to perform a main scanning operation to eject an ink droplet while moving relative to the medium in a main scanning direction which is present;

dividedly holding the six or more inkjet heads in a plurality of arrays comprising at least a first group and a second group in each of which the inkjet heads are disposed side by side in the main scanning direction; and enabling setting, as a printing mode executed, a first printing mode for printing using both of a plurality of inkjet heads disposed side by side in the first group and a plurality of inkjet heads disposed side by side in the second group, and a second printing mode for performing printing using a plurality of inkjet heads disposed side by side in the first group without using a plurality of inkjet heads disposed side by side in the second group;

wherein the ink droplet of black color is ejected from the black color head.

* * * * *